US008363001B2

(12) United States Patent
Tanizoe et al.

(10) Patent No.: US 8,363,001 B2
(45) Date of Patent: Jan. 29, 2013

(54) LIQUID CRYSTAL DISPLAY DEVICE WHICH COMPENSATES FOR TEMPERATURE CHARACTERISTICS IN LIGHT DETECTION AND SPECTRAL TRANSMITTANCE

(75) Inventors: Hideki Tanizoe, Tokyo (JP); Taro Kimura, Tokyo (JP); Hiroshi Ueno, Tokyo (JP); Hiroshi Kato, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 1308 days.

(21) Appl. No.: 11/384,407

(22) Filed: Mar. 21, 2006

(65) Prior Publication Data

US 2006/0221047 A1 Oct. 5, 2006

(30) Foreign Application Priority Data

Mar. 30, 2005 (JP) ..... 2005-098863

(51) Int. Cl.
*G09G 3/36* (2006.01)

(52) U.S. Cl. ..... 345/102

(58) Field of Classification Search ..... 345/101, 345/82, 102, 87; 349/72, 199; 315/307; 331/108
See application file for complete search history.

(56) References Cited

U.S. PATENT DOCUMENTS 4,851,789 A * 7/1989 Dobos ..... 331/108 B
2003/0214467 A1* 11/2003 Koyama et al. ..... 345/82
2003/0230991 A1* 12/2003 Muthu et al. ..... 315/307
2004/0069929 A1* 4/2004 Furukawa et al. ..... 250/208.1
2005/0212824 A1* 9/2005 Marcinkiewicz et al. .... 345/690
2006/0268416 A1* 11/2006 Nixon et al. ..... 359/604

FOREIGN PATENT DOCUMENTS

DE 101 38 005 A1 2/2003
JP 2002-311413 A 10/2002
WO WO-00/36583 A2 6/2000

* cited by examiner

*Primary Examiner* — Dennis Joseph
(74) *Attorney, Agent, or Firm* — Birch, Stewart, Kolasch & Birch, LLP

(57) ABSTRACT

The present invention provides a liquid crystal display device capable of shortening the time required for stabilizing the brightness and the chromaticity to the temperature change. The input of an LED driver is connected to the output of a PWM controller, so that the electric power supplied to the respective LED groups of red, green and blue are controlled with a PWM method. A feedback control means for controlling the PWM controller includes a brightness setting means, a color setting means, a multiplication means for receiving the outputs from the brightness setting means and the color setting means, a comparison means fed with the output of the multiplication means at one of the inputs thereof, a light sensor temperature compensation means for compensating for fluctuations of the output of the light detection means due to temperature changes, a liquid crystal display panel temperature compensation means for compensating for fluctuations of the spectral transmittance of the liquid crystal display panel due to temperature changes, an addition means for summing the result of detection by the light detection means and the output of the light sensor temperature compensation means, and a multiplication means for multiplying the output of the addition means by the output of the liquid crystal display panel temperature compensation means.

18 Claims, 12 Drawing Sheets

5
51
52
53
RED
GREEN
BLUE
6
61
62
63
LED DRIVER (RED)
LED DRIVER (GREEN)
LED DRIVER (BLUE)
7
PWM CONTROLLER
30
EEPROM
17
MPU
TEMPERATURE DETECTION MEANS
3
45
ADC
4
41
42
43
411
412
413
414
415
416
421
422
423
424
425
426
431
432
433
434
435
436
Vs

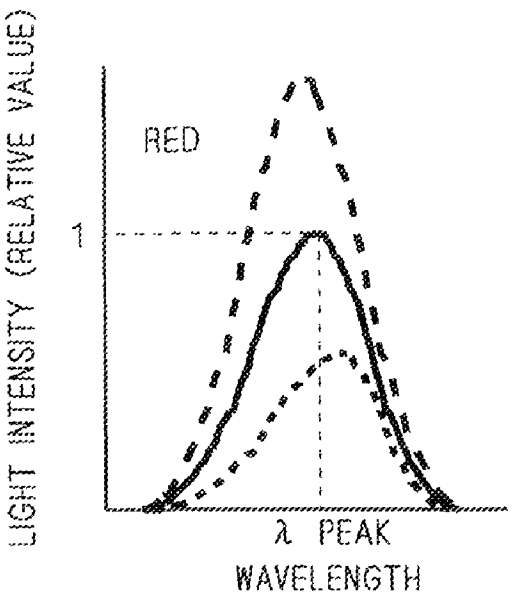
FIG. 9A
PRIOR ART
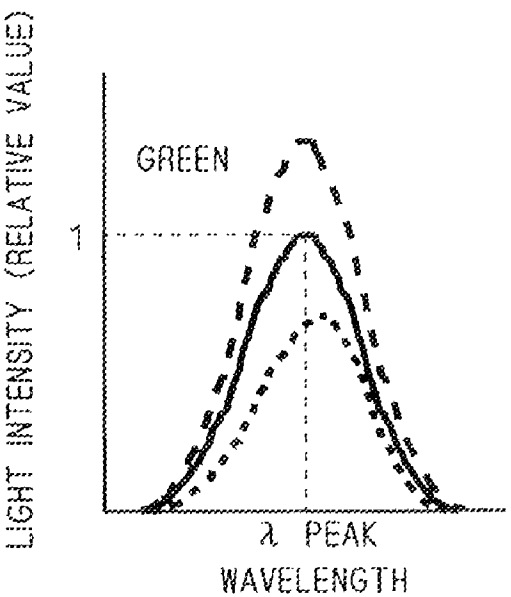
FIG. 9B
PRIOR ART
FIG. 9C
PRIOR ART

LIQUID CRYSTAL DISPLAY DEVICE WHICH COMPENSATES FOR TEMPERATURE CHARACTERISTICS IN LIGHT DETECTION AND SPECTRAL TRANSMITTANCE

BACKGROUND OF THE INVENTION

1. Field of the Invention

The present invention relates to liquid crystal display devices including a backlight and, more particularly, relates to transmitted-light-display type liquid crystal display devices including LEDs (Light Emitting Diodes) as a light source.

2. Description of the Background Art

FIG. 8 is a block diagram illustrating an LED light source stabilization/control circuit 90 disclosed in Armand Perduijn et al., "43.2: Light Output Feedback Solution for RGB LED Backlight Applications", "SID2003 CD-ROM".

The stabilization/control circuit 90 illustrated in FIG. 8 is broadly divided into a color control means 22, a brightness control means 23 and an LED driving duty ratio control means 24.

The color control means 22 is structured to include an addition means 222, an integration means 223, a PWM control block 224, an LED driving/operation detection block 225 and a low-pass filter 226.

The brightness control means 23 is structured to include a brightness sensor 231, an adder 232 and a brightness feedback circuit 233, and the LED driving duty ratio control means 24 is structured to include an adder 241, a maximum duty ratio setting means 242 and an LED driving duty ratio clipping circuit 243.

The brightness control means 23 and the LED driving duty ratio control means 24 constitute a brightness adjustment means 26, in cooperation with a brightness setting means 25 for setting a brightness value (Y').

In the stabilization/control circuit 90, XYZ values (a color set value) as control targets are set by a color setting means 20, and these values and the output of the brightness adjustment means 26 are supplied to a multiplication means 21 which performs multiplication thereof. The result of the multiplication is supplied to the addition means 222 in the color control means 22.

In addition thereto, the output of the LED driving/operation detection block 225 is fed back to the addition means 222 through the low-pass filter 226 so that the difference between the output from the LED driving/operation detection block 225 and the result of the multiplication from the multiplication means 21 is supplied to the integration means 223.

Further, the output of the integration means 223 is supplied to the PWM control block 224 which calculates the duty ratios for PWM driving of the red, green and blue LEDs. The PWM control block 224 is structured to enable setting the gain of the integration component of the PWM control for the amount of feedback.

The LED driving/operation detection block 225 includes three types of LEDs for generating red, green and blue lights, a PWM driving circuit which individually drives the three types of LEDs, and a color detection means which disperses white light generated from a light guide plate through color filters which are approximated to a CIE1931XTZ color matching function and detects the X', Y' and Z' values (color detected values) of separated lights, wherein light guide plate mixes the red, green and blue monochromatic lights generated from the LEDs into white light.

The output of the PWM control block 224 is supplied to a PWM driving circuit in the LED driving/operation detection block 25.

The X', Y' and Z' values (color detected values) which are output from the LED driving/operation detection block 25 through the low pass filter 226 are also supplied to the brightness control means 23, and a brightness sensor 231 detects only the brightness value Y' and supplies it to the addition means 232.

On the other hand, a brightness value Y' set by the brightness setting means 25 and the brightness value Y' output from the LED driving/operation detection block 25 are supplied to the addition means 232 which outputs the difference therebetween. The difference is supplied to the brightness feedback circuit 233 in the brightness control means 23 where it is subjected to a PID (Proportional, Integral, Differential) comparison control. Further, the brightness feedback circuit 233 is structured to enable setting the gain of the integration component of the PID comparison control for the amount of feedback.

The value resulted from the comparison controlling process by the brightness feedback circuit 233 is supplied to the addition means 241 of the LED driving duty ratio control means 24 which outputs the difference between this value and the output from the PWM control block 224 to the LED driving duty ratio clipping circuit 243.

On receiving the output of the addition means 241, the LED driving duty ratio clipping circuit 243 calculates a PWM duty ratio (common to red, green and blue colors) for the LEDs, on the basis of the output, Then, the result of the calculation is supplied to one of the inputs of the multiplication means 21.

Further, the LED driving duty ratio clipping circuit 243 is structured to enable setting the gains of the proportional component and the integration component of the PID comparison control for the amount of feedback.

In the aforementioned stabilization/control circuit 90, when the duty ratio of the PWM driving for the LEDs reaches a certain value, the overall gain is reduced and a feedback operation is performed in such a manner as to prevent the color fluctuation due to the clipping of the duty, thereby stably controlling the light intensities of the red, green and blue LEDs of the backlight source and the balance thereamong.

FIGS. 9A, 9B and 9C illustrate exemplary temperature-induced fluctuation characteristics of the light emission spectra of blue, green and red LEDs.

In FIGS. 9A, 9B and 9C, the horizontal axis represents the wavelength while the vertical axis represents the light intensity (relative value), and there are illustrated, in a superimposing manner, the light-emission spectra of the LEDs of the respective colors, for casing temperatures Tc of +25° C., +85° C. and −20° C. at the casing housing the LEDs.

Further, in FIGS. 9A, 9B and 9C, the light-emission spectra at the respective temperatures are illustrated, on the assumption that the peak light intensity (λ peak) at a casing temperature of +25° C. is 1.

As can be seen from FIGS. 9A, 9B and 9C, the light-emission intensities of the LEDs of the respective colors are varied with the temperature. Conventionally, such effects of temperature changes have been compensated for through feedback controls using, for example, the stabilization/control circuit 90 described with reference to FIG. 8.

Further, Japanese Patent Application Laid-Open No. 2002-311413 (FIG. 4) discloses a technique for determining the brightness of a backlight and the temperature within the device and then correcting the brightness on the basis of the temperature within the device in order to attain a target brightness.

As described above, the stabilization/control circuit for the LED light source described in the aforementioned literature can stably control the brightness and the chromaticity of only the backlight source. However, the light sensing circuit used as light detection means has the possibility of causing fluctuations of the electric current output of the photodiodes used for light detection due to temperature changes and also has the possibility of causing fluctuations of the resistance of the resistor used in the amplification circuit for converting the electric current outputs of the photodiodes into voltages, due to temperature changes.

FIG. 10 illustrates the relationship between the output voltages of light sensors for red, green and blue colors and the operating temperature.

In FIG. 10, the horizontal axis represents the temperature (° C.) while the vertical axis represents the output voltage (V), wherein the output voltage characteristic of the light sensor for the red color (R) is plotted with a rectangular mark, the output voltage characteristic of the light sensor for the green color (G) is plotted with a round mark, and the output voltage characteristic of the light sensor for the blue color (B) is plotted with a triangular mark. The left vertical axis and the right vertical axis have different scales and the left vertical axis is marked in 0.005 V increments while the right vertical axis is marked in 0.2 V increments. The left vertical axis represents the output voltage of the light sensor for the green color, while the right vertical axis represents the output voltages of the light sensors for the red and blue colors.

In spite of the scale difference, FIG. 10 shows that the output voltage of the light sensor for the green color exhibits greatest temperature dependence, and there are also observed slight fluctuations in the output voltages of the blue and red light sensors.

Further, a liquid crystal display panel employing LED light sources as the backlight also exhibits a spectral transmittance which varies with the temperature.

FIG. 11 illustrates a temperature characteristic of the transmittance of a liquid crystal display panel.

In FIG. 11, the horizontal axis represents the wavelength (nm) while the vertical axis represents the light intensity (relative value) which is transmitted through the liquid crystal display panel, wherein there are illustrated the transmittances for respective wavelengths for temperatures of 24.5° C. and 43° C. at the liquid crystal display panel, thereby showing that the transmittances are decreased with increasing temperature.

In FIG. 11, the transmittances for respective wavelengths are illustrated, on the assumption that the light intensity for a wavelength of 523 nm at a liquid crystal display panel temperature of 24.5° C. is 1.

Since the operating temperature of the light sensors and the operating temperature of the liquid crystal display panel are increased with the elapsed time after power-on, the detection characteristic of the light sensors and the spectral transmittance of the liquid crystal panel are also changed with the elapsed time.

FIG. 12 illustrates the result of tests for the fluctuation in a light feedback controlling operation for an experimentally-produced liquid crystal display panel including a stabilization/control circuit equivalent to the stabilization/control circuit 90 illustrated in FIG. 8, in the cases of using a cabinet (enclosure) or no cabinet.

In FIG. 12, the vertical axis represents the color difference (ΔEab) from finally stably obtained brightness and chromaticity, while the horizontal axis represents the elapsed time (min).

As can be seen from FIG. 12, the liquid crystal display requires about 250 minutes for stabilizing the color difference when it employs the cabinet while it can stabilize it within about 100 minutes when it employs no cabinet. Thus, the feedback converging time is largely varied depending on whether or not there is a cabinet.

It can be considered that the aforementioned phenomenon is caused by the difference in the heat release at the backlight LED light source portion between when there is a cabinet and when there is no cabinet.

As described above, conventional stabilization/control circuits for LED light sources have been susceptible to the temperature change within the cabinet of the liquid crystal display panel and the temperature change in the liquid crystal display panel, thereby requiring longer times for stabilizing the brightness and the chromaticity.

Further, although Japanese Patent Application Laid-Open No. 2002-311413 discloses correction of brightness on the basis of the temperature in the device in order to attain a target temperature, the device does not employ LEDs as the light source.

SUMMARY OF THE INVENTION

It is an object of the present invention to provide a liquid crystal display device employing LEDs as light sources which can reduce the time required for stabilizing the brightness and the chromaticity to the temperature change.

A liquid crystal display device according to the present invention uses, as backlight of a liquid crystal display panel, white light generated from a light guide plate adapted to mix plural monochromatic lights into white light. The liquid crystal display device includes a control means that individually controls the light intensities of plural light sources for the plural monochromatic lights, a light detection means that detects the brightness of the white light of the backlight, a temperature detection means that measures the temperature in the vicinity of the liquid crystal display panel, and a feedback control means that receives the brightness detection value detected by the light detection means and performs a feedback control to the control means in terms of the electric power supplied to the plural light sources such that the brightness detection value is brought into agreement with a set brightness. Herein, the feedback control means includes a first temperature compensation means that sets a first compensation value to the temperature characteristic of the output of the light detection means caused by the temperature change, on the basis of the detected temperature by the temperature detection means, and a second temperature compensation means that sets a second compensation value to the temperature characteristic of the spectral transmittance of the liquid crystal display panel caused by the temperature change, on the basis of the detected temperature. The feedback control means performs the feedback control on the basis of the first and second compensation values.

According to the liquid crystal display device, a feedback control means includes a first temperature compensation means for setting a first compensation value to the temperature characteristic of the output of a light detection means due to the temperature change, on the basis of the detected temperature detected by a temperature detection means, and a second temperature compensation means for setting a second compensation value to the temperature characteristic of the spectral transmittance of the liquid crystal display panel due to the temperature change, on the basis of the detected temperature, and performs a feedback control of the electric power supplied to plural light sources on the basis of the first and second compensation values. Therefore, it is possible to suppress the fluctuations of the brightness and the chromaticity of white light due to the temperature rise within the display cabinet after power-on, thereby stabilizing the brightness and the chromaticity of white light soon after power-on.

These and other objects, features, aspects and advantages of the present invention will become more apparent from the following detailed description of the present invention when taken in conjunction with the accompanying drawings.

BRIEF DESCRIPTION OF THE DRAWINGS

FIG. 9 illustrates temperature changes in the light emission spectra of LEDs;

DESCRIPTION OF THE PREFERRED EMBODIMENTS

A. First Embodiment (A-1. Device Configuration)

Figure 1:
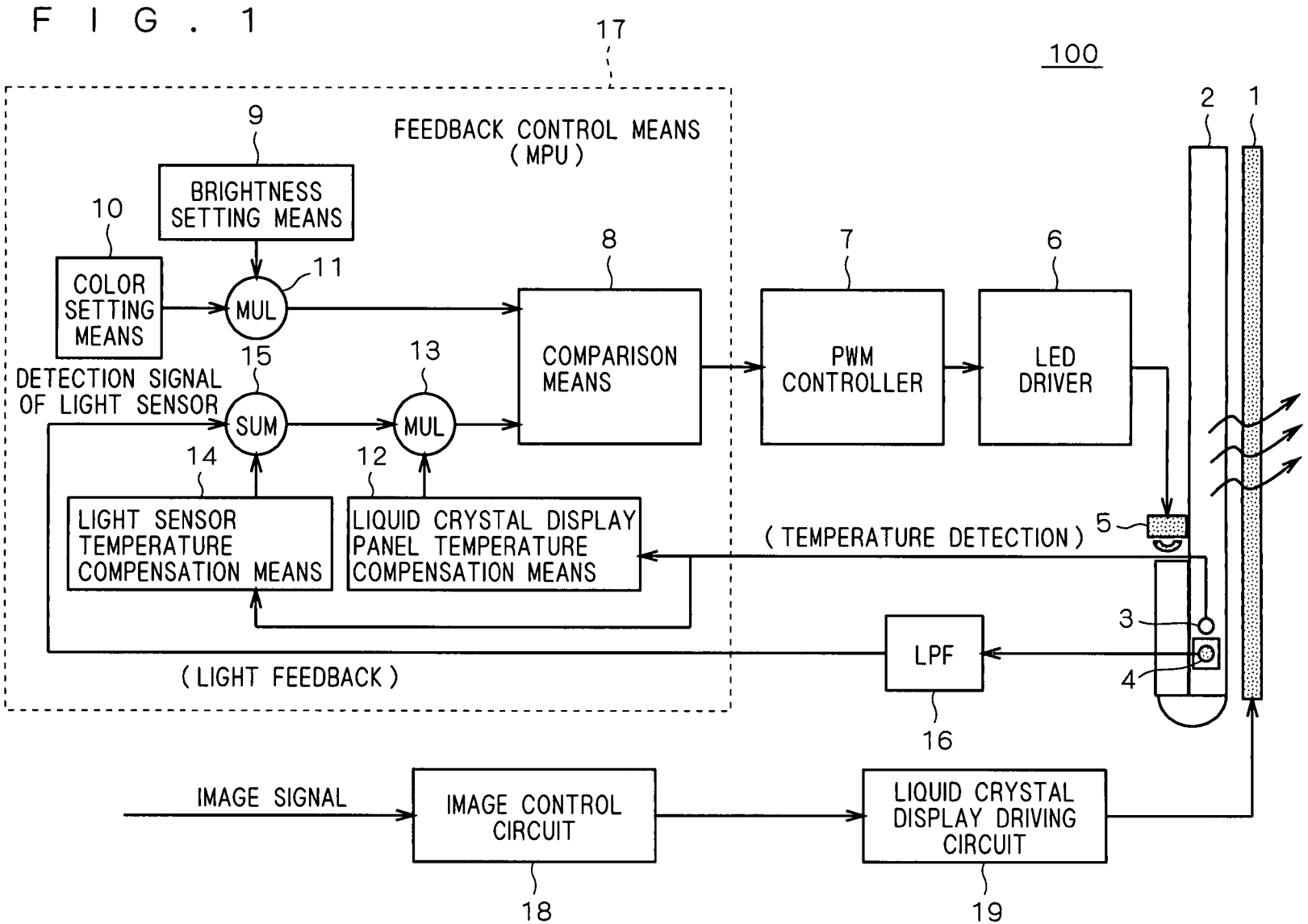
FIG. 1 is a block diagram illustrating the structure of a liquid crystal display device according to a first embodiment of the present invention.

FIG. 1 is a block diagram illustrating the structure of a liquid crystal display device 100 according to a first embodiment of the present invention.

The liquid crystal display device 100 illustrated in FIG. 1 is structured such that a feedback control means 17 performs feedback control of a PWM controller 7 and an LED driver 6 on the basis of information about the temperature of a light guide plate 2 and information about the intensities of red light, green light and blue light, which are output from a temperature detection means (temperature sensor IC) 3 and a light detection means (light sensor IC) 4 mounted on the light guide plate 2.

Namely, the light guide plate 2 constituting a backlight system is mounted to the back surface (the surface opposite from the display surface) of a liquid crystal display (LCD) panel 1. The light guide plate 2 is a member for mixing red (R), green (G) and blue (B) monochromatic lights generated from an LED backlight source 5 into white light and includes a diffusion sheet and a reflection sheet, not illustrated, which are attached to the back surface thereof (the surface opposite from the LCD panel).

Further, the temperature detection means 3 and the light detection means 4 are mounted to an edge portion of the light guide plate 2 at positions adjacent to each other. The light detection means 4 is constituted by color filters for three colors, R, G and B, and photoelectric conversion devices (silicon photodiodes or the like) associated with the respective corresponding color filters and is structured to disperse backlight white light into red, green and blue lights and detect the light intensities thereof. Also, the temperature detection means 3 may be placed in the vicinity of the light guide plate 2, instead of being directly mounted to the light guide plate 2.

A liquid crystal display driving circuit 19 drives the LCD panel 1 to display, thereon, images in accordance with image signals supplied from an image control circuit 18, which is connected to the liquid crystal display driving circuit 19. Color filters for the three colors, red, green and blue, are attached to the front surface of the liquid crystal display panel 1 in correspondence to the respective pixels to pass, therethrough, only red, green and blue monochromatic lights resulted from the dispersion of the white color generated from the light guide plate 2.

The LED backlight source 5 is constituted by an LED module including three types of LED groups, each group consisting of plural LEDs for generating light with a wavelength of a corresponding color, out of red (R), green (G) and blue (B). Further, the LED backlight source 5 is configured to be driven by the LED driver 6 having three channels for driving the respective LED groups for red (R), green (G) and blue (B).

The input of the LED driver 6 is connected to the output of the PWM controller 7 so that the electric power supplied to the respective LED groups of red, green and blue are controlled with a PWM (Pulse Width Modulation) method.

The feedback control means 17 for controlling the PWM controller 7 is configured to include a brightness setting means 9, a color setting means 10, a multiplication means 11 which receives the outputs from the brightness setting means 9 and the color setting means 10, a comparison means 8 which is fed with the output of the multiplication means 11 at one of the inputs thereof, a light sensor temperature compensation means (first temperature compensation means) 14 for compensating for fluctuations of the output of the light detection means 4 due to the temperature change, a liquid crystal display panel temperature compensation means (second temperature compensation means) 12 for compensating for fluctuations of the spectral transmittance of the liquid crystal display panel due to the temperature change, an addition means 15 for summing the result of detection by the light detection means 4 and the output of the light sensor temperature compensation means 14, and a multiplication means 13 for multiplying the output of the addition means 15 by the output of the liquid crystal display panel temperature compensation means 12.

Further, the output of the light detection means 4 is supplied to the addition means 15 in the feedback control means 17 through a low-pass filter 16 for cutting a PWM frequency region for driving the LEDs. When the response speed of the light detection means 4 is greater than the PWM frequency for driving the LEDs, the PWM frequency component is superimposed on the output of the light detection means 4 as noise in the low-pass filter 16. Accordingly, the low-pass filter 16 is provided for eliminating such noise.

Further, the output of the temperature detection means 3 is supplied to the aforementioned light sensor temperature compensation means 14 and the liquid crystal display panel temperature compensation means 12.

Figure 2:
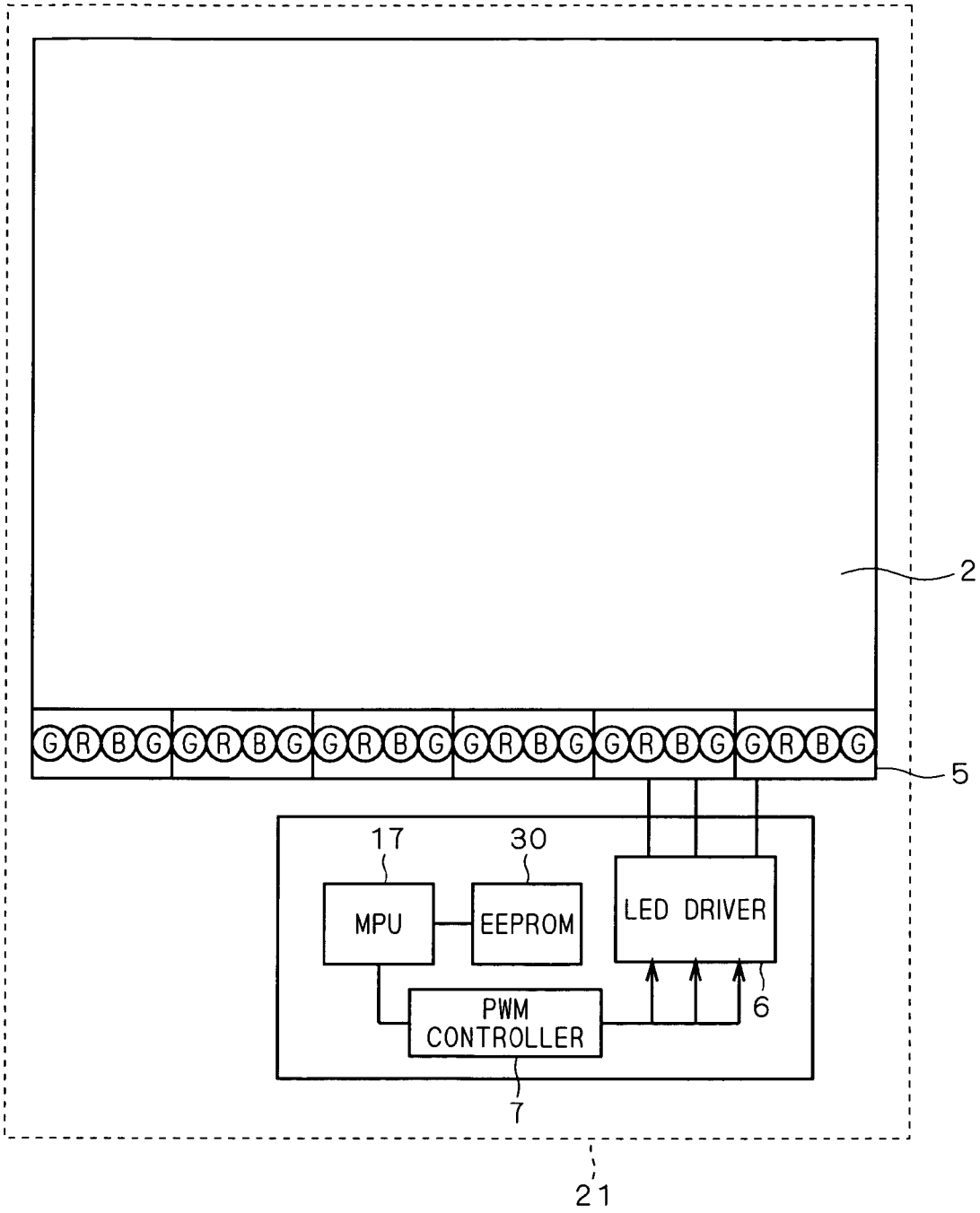
FIG. 2 is a block diagram illustrating the structure the backlight system of the liquid crystal display device according to the first embodiment of the present invention.

FIG. 2 is a block diagram illustrating the structure of a backlight system 21 used in the liquid crystal display device 100.

As illustrated in FIG. 2, the LED backlight source 5 includes red LEDs, blue LEDs and green LEDs which are alternately arranged in serial to constitute three types of LED groups, each group consisting of plural LEDs having the corresponding color, wherein the respective LED groups are driven by the LED driver 6 having three channels.

Further, the feedback control means 17 may be realized by, for example, an MPU (microprocessing unit) and, therefore, it will be designated as an MPU 17, in some cases, hereinafter.

Although not illustrated in FIG. 1, a nonvolatile memory 30 which is constituted by, for example, an EEPROM (Electrically Erasable Programmable Read Only Memory) is connected to the MPU 17.

Figure 3:
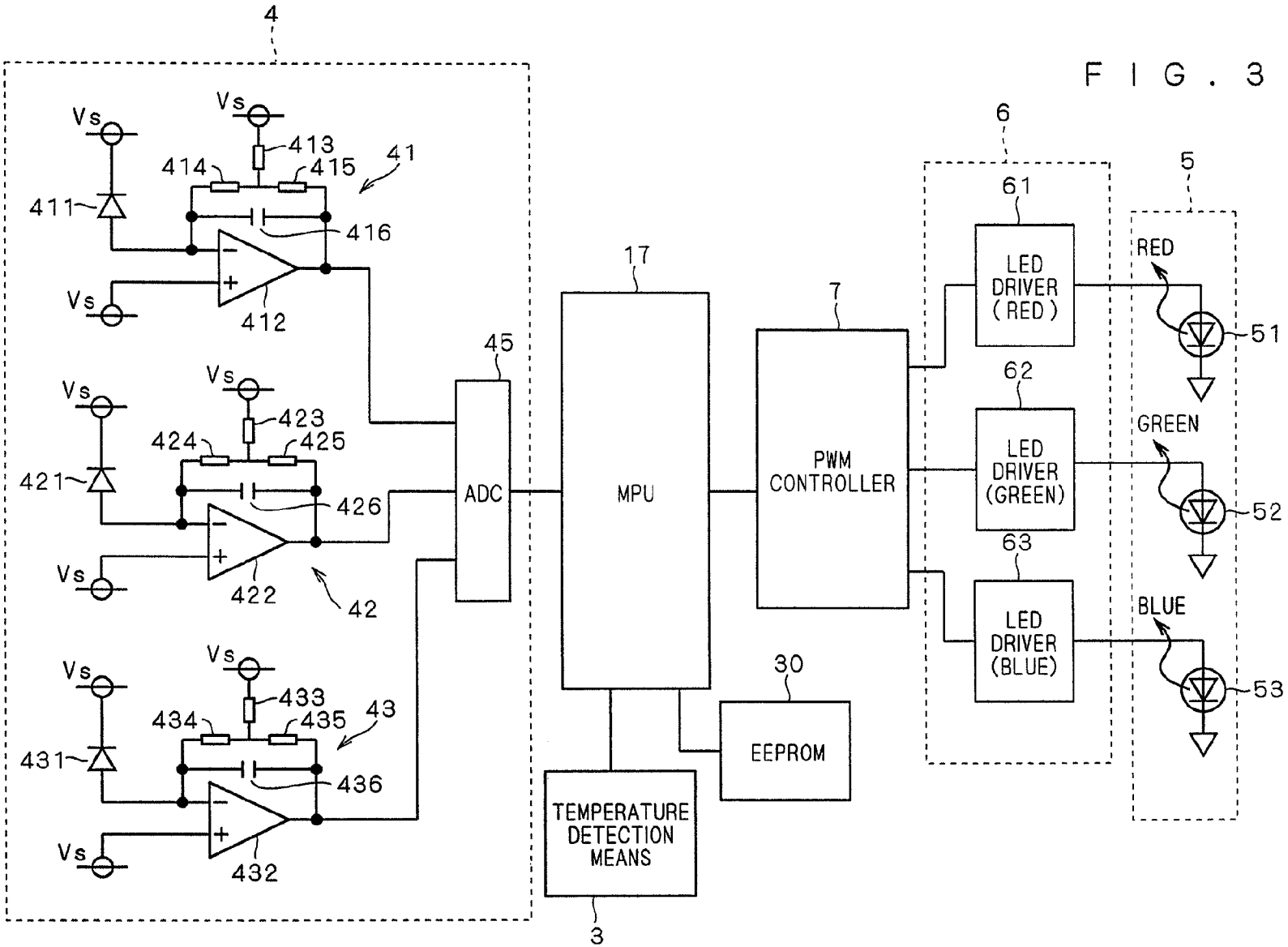
FIG. 3 is a block diagram illustrating, in more detail, the structure of the liquid crystal display device according to the first embodiment of the present invention.

FIG. 3 illustrates the respective structures of the light detection means 4, the LED driver 6 and the LED backlight source 5.

As illustrated in FIG. 3, the light detection means 4 includes detection circuits 41, 42 and 43 for the three systems (channels) of red, green and blue and an AD conversion circuit (ADC) 45, wherein the output of the AD conversion circuit 45 is connected to an input/output terminal of the MPU 17.

The detection circuits 41 to 43 have basically the same structure and, hereinafter, description of the structure will be provided by exemplifying the detection circuit 41.

A photodiode 411 forming a light receptive portion (which is associated with a filter which passes only red light therethrough) is connected at its anode to the negative input of an operational amplifier 412 and the positive input of the operational amplifier 412 is connected to a power supply terminal Vs. The cathode of the photodiode 411 is connected to the power supply terminal Vs.

Between the negative input and the output of the operational amplifier 412, there are interposed feedback resistances 414 and 415 connected in serial to each other and a capacitor 416 for preventing oscillation.

A resistance 413 is interposed between the connection node of the feedback resistances 414 and 415 and the power supply terminal Vs so that the gain of the operational amplifier 412 can be adjusted through the feedback resistances 414 and 415 and the resistance 413 and the output of the operational amplifier 412 is supplied, as the output of the detection circuit 41, to the AD conversion circuit 45.

The detection circuits 42 and 43 have the same structure as that of the detection circuit 41, except that their respective photodiodes 421 and 431 are associated with filters which pass only green and blue lights therethrough, respectively. The components of the detection circuit 41 designated by the reference characters 412 to 416 correspond to the components designated by the reference characters 422 to 426 and the reference characters 432 to 436.

The PWM controller 7 connected to the MPU 17 drives, in a PWM manner, drivers 61, 62 and 63 which respectively control the operations of the red, green and blue LED groups 51, 52 and 53 constituting the LED backlight source 5.

(A-2. Device Operation)

Figure 4:
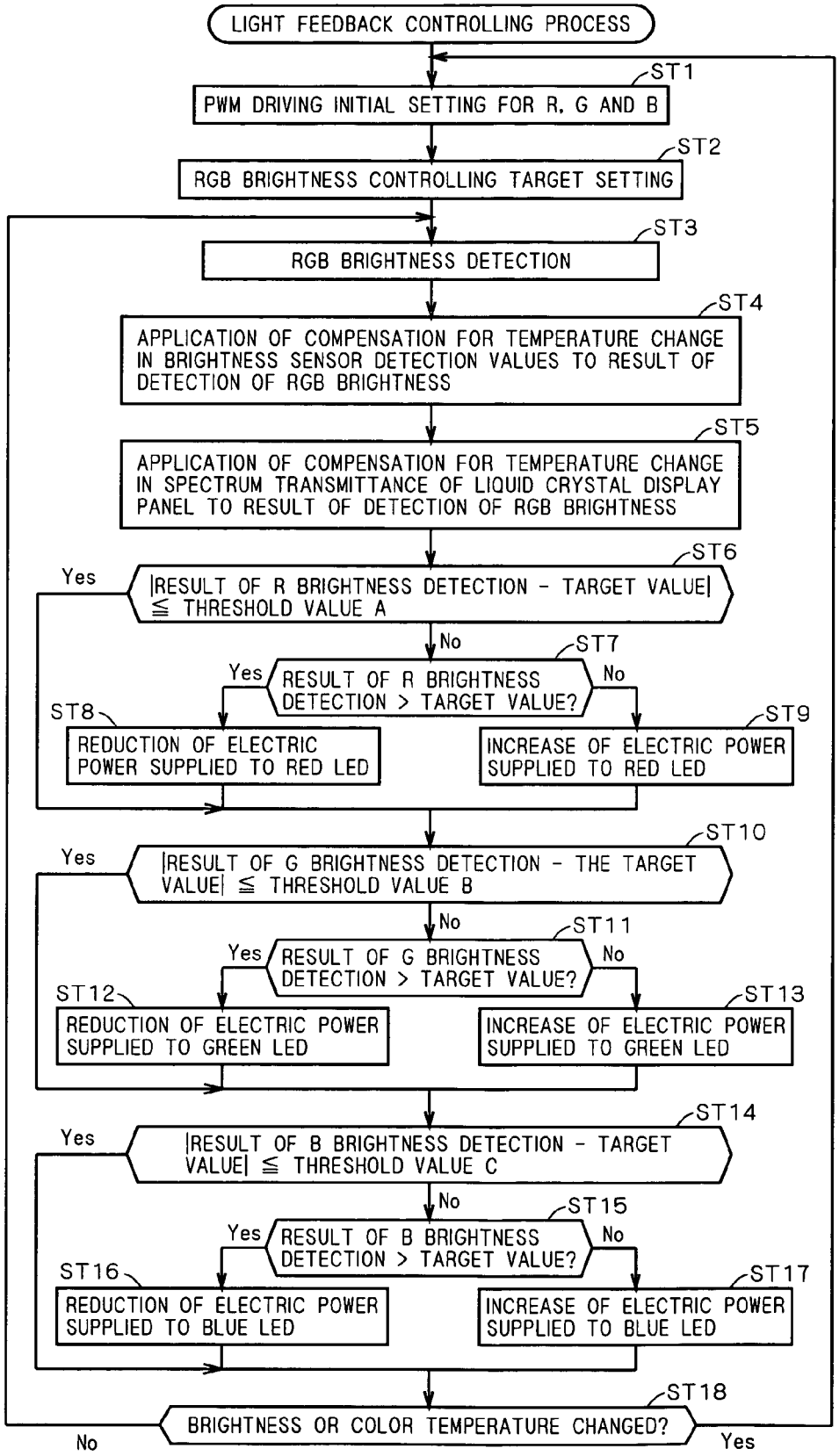
FIG. 4 is a flowchart illustrating a light feedback control processing operation in the liquid crystal display device according to the first embodiment of the present invention.

Next, with reference to a flowchart of FIG. 4, there will be described a light feedback control processing operation in the liquid crystal display device 100.

(A-2-1. Step ST1)

At power-on of the display, the MPU 17 performs initial setting of the PWM-control outputs of the PWM controller 7 for red (R), green (G) and blue (B) (step ST1).

At this time, PWM set values (for the respective channels for R, G and B) which were used last in the previous operation and stored in the nonvolatile memory 30 (FIG. 3) may be read for use as the initial set values, wherein the previous operation means a continuous operation starting with the activation of the liquid display device 100 until the power shutdown.

(A-2-2. Step ST2)

Then, feedback control target values (brightness control target values) corresponding to the R, G and B output values of the light detection means 4 are set, in accordance with a predetermined color temperature (Step ST2).

Further, in the following description, the light detection means 4 will be described as being a brightness sensor 4. Further, since the color of emitted light from the light guide plate 2 can be determined by detecting the brightnesses of the respective colors, R, G and B, and calculating the color using the brightnesses, the brightness sensor 4 can also be referred to as a color detection means.

Here, the predetermined color temperature is the color temperature of white light and may be set to, for example, 5000 K (Kelvin). The initial values of the feedback-control target values are values for controlling the brightness balance of the respective LEDs for R, G and B such that the white light of the LCD panel 1 is adjusted to have this color temperature. More specifically, during manufacturing of the liquid crystal display device 100, the white color point of the display surface of the LCD panel 1 is determined using a brightness sensor and a color sensor while the driving of the LEDs is adjusted and set such that the display surface of the LCD panel 1 has the predetermined color temperature, the brightnesses (of the respective colors, R, G and B) of the light guide plate 2 are detected at this state, and the detected values are defined as the initial values of the feedback-control target values. Consequently, the state of light emission from the display surface of the LCD panel 1 can be associated with the state of light emission from the light guide plate 2, with numerical values. The initial values of the feedback-control target values are stored in the nonvolatile memory 30 incorporated in the liquid crystal display device 100.

The feedback-control target values set in step ST2 are set and determined on the basis of the initial values of the R, G and B feedback-control target values, which have been stored in advance in the nonvolatile memory 30 on the basis of the predetermined color temperature, according to the following calculation equations (1), (2) and (3) for the set brightnesses.

$$\text{Feedback control target value for red channel} = (\text{Brightness}/(\text{Maximum brightness}))\times\text{Feedback control target value at maximum brightness for red channel} \quad (1)$$

$$\text{Feedback control target value for green channel} = (\text{Brightness}/(\text{Maximum brightness}))\times\text{Feedback control target value at maximum brightness for green channel} \quad (2)$$

$$\text{Feedback control target value for blue channel} = (\text{Brightness}/(\text{Maximum brightness}))\times\text{Feedback control target value at maximum brightness for blue channel} \quad (3)$$

Here, the feedback-control target value at a maximum brightness for the red channel, the feedback-control target value at a maximum brightness for the green channel, and the feedback-control target value at a maximum brightness for the blue channel correspond, respectively, to the initial values of the R, G and B feedback-control target values which have been stored in advance in the nonvolatile memory 30.

(A-2-3. Step ST3)

Next, the R, G and B output values of the brightness sensor 4 are detected in step ST3.

The outputs of the brightness sensor 4 are introduced to the MPU 17 through the AD conversion circuit 45 previously described using FIG. 3 and, at this time, noise removing processes may be performed concurrently therewith.

For example, the AD conversion circuit 45 may repeatedly perform AD conversion plural times at constant time intervals under the control of the MPU 17, then the resultant plural output values except the maximum and minimum values may be averaged, and the average value may be introduced to the MPU 17. By eliminating the maximum and minimum values, noise peak components can be eliminated. Also, the resultant plural output values may be simply averaged.

(A-2-4. Step ST4)

Next, in step ST4, compensation for the temperature change is applied to the output values of the R, G and B brightness sensors 4 This process is performed by the light sensor temperature compensation means 14 and the addition means 15 in the MPU 17 illustrated in FIG. 1.

For the compensation, the gain change in the brightness sensor 4 and the dark-current change in the brightness sensor 4 are taken into account, as factors variable with the temperature. The changes due to both the factors are defined as a first-degree equation and are compensated for on the basis of the following equation (4).

$$ADCt(X)=ADC_T(X)+\text{Gain change in brightness sensor}+\text{Dark current change in brightness sensor}=ADC_T(X)+\Delta t\bullet a(X)+b \quad (4)$$

The processing for Δt•a(X)+b in the aforementioned equation (4) is performed by the temperature compensation means 14, and this process can be referred to as a process of setting a compensation value (first compensation value) to the temperature characteristic of the output of the brightness sensor 4.

Detection value of temperature sensor at brightness value of X: T(X)

Detection value of brightness sensor at brightness value of X: $ADC_T(X)$

Reference value of temperature sensor at brightness value of X: t(X)

Temperature compensated brightness sensor detection value at brightness value of X: $ADC_t(X)$ Gain change coefficient of brightness sensor at brightness value of X: a(X)

Dark current change coefficient of brightness sensor at brightness value of X: b Temperature difference from reference temperature at brightness value of X:

$$\Delta t(X)=t(X)-T(X)$$

Out of the aforementioned parameters, the reference value of the temperature sensor at a brightness value of X indicates the temperature detected by the temperature detection means 3 at a brightness value of X during the previously described white-color-point adjustment. Further, this reference value is used as the reference temperature, and the temperature compensation values are defined as a function of the temperature change (Δt) with respect to the reference temperature.

The brightness sensors for the respective colors exhibit different gain change coefficients a(X) at a brightness value of X and, therefore, the calculation equation (4) is represented as follows, in taking into account of the difference among the R, G and B brightness sensors (the difference of the detected-value change per unit temperature change).

$$ADCt(X)(R)=ADC_T(X)+\Delta t\bullet a(X)(R)+b(R) \quad (5)$$

$$ADCt(X)(G)=ADC_T(X)+\Delta t\bullet a(X)(G)+b(G) \quad (6)$$

$$ADCt(X)(B)=ADC_T(X)+\Delta t\bullet a(X)(B)+b(B) \quad (7)$$

Here, ADCt(X)(R), ADCt(X)(G) and ADCt(X)(B) indicate the temperature-compensated detected values of the brightness sensors for the red channel, the green channel and the blue channel at a brightness of X. Further, a(X)(R), a(X)(G) and a(X)(B) indicate the gain change coefficients of the brightness sensors for the red channel, the green channel and the blue channel at a brightness of X. Further, b(R), b(G) and b(B) indicate the dark-current change coefficients of the brightness sensors for the red channel, the green channel and the blue channel. Hereinafter, description will be provided on the basis of the calculation equation (4), for convenience.

(A-2-4-1. Determination of Gain Change Coefficient of Brightness Sensor)

Here, the gain change coefficient a(X) of a brightness sensor is determined according to the following calculation equation (8).

$$a(X)=\{ADC(\text{Top})-ADC(Bot)\}\bullet(\text{Base_}a(X)/\{\text{Base_}ADC(\text{Top})-\text{Base_}ADC(Bot)\} \quad (8)$$

Reference ADC upper limit of brightness sensor: Base_ADC (Top)

Reference ADC lower limit of brightness sensor: Base_ADC (Bot)

Reference temperature change coefficient of brightness sensor: Base_a (X)

The reference ADC upper limit of the brightness sensor is defined as follows.

That is, the reference ADC upper limit is defined as the output value of the AD conversion circuit 45 obtained by introducing, to the AD conversion circuit 45 (FIG. 3), the voltage output from the brightness sensor at a maximum operable dynamic range thereof within its designed standard output operation range.

The reference ADC lower limit of the brightness sensor is defined as follows.

That is, the reference ADC lower limit is defined as the output value of the AD conversion circuit 45 obtained by introducing, to the AD conversion circuit 45 (FIG. 3), the voltage output from the brightness sensor at a minimum operable dynamic range thereof within its designed standard output operation range.

Further, the reference temperature change coefficient of the brightness sensor is a coefficient indicative of the designed standard gain change of the brightness sensor with respect to the temperature change.

Further, the coefficient defined as (Base_a(X)/{Base_ADC(Top)−Base_ADC(Bot)} in the right-hand side of the calculation equation (8) is stored, as a correction coefficient (parameter) value, in the nonvolatile memory 30 (FIG. 3).

Further, the aforementioned correction coefficient can be rewritten by an operator during manufacturing, through operations of adjustment push buttons provided on the OSD (On Screen Display) and the display bezel portion or through commands transmitted via means for communicating with external devices.

Further, ADC(Top) and ADC(Bot) in {ADC(Top)−ADC(Bot)} in the left-hand side of the calculation equation (8) indicate the outputs of the AD conversion circuit 45 which correspond to the maximum output voltage and the minimum output voltage of the brightness sensor. Further, ADC(Top) and ADC(Bot) are values specific to the liquid crystal display device and are stored in the nonvolatile memory 30 (FIG. 3). Further, these values can be also rewritten by an operator during manufacturing, through operations of adjustment push buttons provided on the OSD (On Screen Display) and the display bezel portion or through commands transmitted via means for communicating with external devices.

(A-2-4-2. Determination of Dark Current Change Coefficient of Brightness Sensor)

Here, the dark-current change coefficient b of the brightness sensor is determined according to the following calculation equation (9).

$$b=\Delta Isens \cdot Rsens \cdot ADC\text{range}/Vsens \quad (9)$$

Electric current change: ΔIsens

Resistance for converting sensor electric current into voltage: Rsens

Variable range of sensor output voltage: Vsens

Sensor ADC detection output range: ADCrange

The aforementioned parameters are individually defined for the red, green and blue channels, and the dark-current change coefficient b of the brightness sensor is varied depending on the channel, as indicated by the calculation equations (5) to (7).

(A-2-5. Step ST5)

Next, in step ST5, compensation for the temperature change in the spectral transmittance of the liquid crystal display panel is applied to the temperature-compensated brightness-sensor detection value ADCt(X), which has been resulted from the compensation for the temperature change in the detection values of the R, G and B brightness sensors 4 on the basis of the calculation equation (4). This process is executed by the liquid crystal display panel temperature compensation means 12 and the multiplication means 13 in the MPU 17 illustrated in FIG. 1.

This compensating process is performed on the basis of the following calculation equations (10) to (12).

$$ADC_{LCDT(R)}=ADCt(X)(R)\cdot\Delta t\cdot LCD\text{drift}(R) \quad (10)$$

$$ADC_{LCDT(G)}=ADCt(X)(G)\cdot\Delta t\cdot LCD\text{drift}(G) \quad (11)$$

$$ADC_{LCDT(B)}=ADCt(X)(B)\cdot\Delta t\cdot LCD\text{drift}(B) \quad (12)$$

The processing for Δt•LCDdrift(R), Δt•LCDdrift(G) and Δt•LCDdrift(B) in the aforementioned equations (10) to (12) is executed by the liquid crystal display panel temperature compensation means 12 and, this processing can be referred to as processing for setting a value (second compensation value) to the temperature characteristic of the spectral transmittance of the liquid crystal display panel.

$ADC_{LCDT}$(R): panel temperature compensated detection value of red channel brightness sensor $ADC_{LCDT}$(G): panel temperature compensated detection value of green channel brightness sensor $ADC_{LCDT}$(B): panel temperature compensated detection value of blue channel brightness sensor ADCt(X)(R): detection value of red channel brightness sensor (after sensor temperature compensation)

ADCt(X)(G): detection value of green channel brightness sensor (after sensor temperature compensation)

ADCt(X)(B): detection value of blue channel brightness sensor (after sensor temperature compensation)

LCDdrift(R): temperature change coefficient of liquid crystal display panel, for red channel LCDdrift(G): temperature change coefficient of liquid crystal display panel, for green channel LCDdrift(B): temperature change coefficient of liquid crystal display panel, for blue channel The temperature change coefficients of the liquid crystal display panel, for the respective channels are coefficients indicating the change of the spectral transmittance with respect to the temperature change in the liquid crystal display panel and, these coefficients for the respective channels are determined and set during manufacturing and are stored in the nonvolatile memory 30 (FIG. 3). Also, these values can be rewritten by an operator during manufacturing, through operations of adjustment push buttons provided on the OSD (On Screen Display) and the display bezel portion or through commands transmitted via means for communicating with external devices.

(A-2-6. Step ST6)

Next, in step ST6, a comparison is made between the panel-temperature-compensated detection value of the red-channel brightness sensor resulted from the calculation equation (10) and the red-channel feedback-control target value defined according to the calculation equation (1) to calculate the absolute difference value therebetween and, then, it is determined whether or not the absolute difference value is equal to or less than a predetermined threshold value (threshold value A). This determination operation is executed by a comparison means 8 in the MPU 17 illustrated in FIG. 1.

If the difference between the detection value and the target value is equal to or less than the threshold value A, the process proceeds to step ST10. On the other hand, if the difference between the detection value and the target value exceeds the threshold value A, the process proceeds to step ST7.

(A-2-7. Step ST7)

In step ST7, it is determined whether or not the panel-temperature-compensated detection value of the red-channel brightness sensor is greater than the red-channel feedback-control target value.

If the detection value is determined to be greater than the target value, the process proceeds to step ST8. If the detection value is determined to be smaller than the target value, the process proceeds to step ST9.

(A-2-8. Step ST8)

In step ST8, the PWM controller 7 is controlled such that the electric power supplied to the red LED group 51 (FIG. 3) is reduced by a certain amount and, thereafter, the process proceeds to step ST10.

(A-2-9. Step ST9)

In step ST9, the PWM controller 7 is controlled such that the electric power supplied to the red LED group 51 (FIG. 3) is increased by a certain amount and, thereafter, the process proceeds to step ST10. The amounts of increase and reduction of the supplied electric power are determined in advance in consideration of the characteristics of the respective LEDs and the operation characteristics of the liquid crystal display panel 1 and the like.

(A-2-10. Step ST10)

In step ST10, a comparison is made between the panel-temperature-compensated detection value of the green-channel brightness sensor resulted from the calculation equation (11) and the green-channel feedback-control target value defined according to the calculation equation (2) to calculate the absolute difference value therebetween and, then, it is determined whether or not the absolute difference value is equal to or less than a predetermined threshold value (threshold value B). This determination operation is executed by the comparison means 8 in the MPU 17 illustrated in FIG. 1.

If the difference between the detection value and the target value is equal to or less than the threshold value B, the process proceeds to step ST14. On the other hand, if the difference between the detection value and the target value exceeds the threshold value B, the process proceeds to step ST11.

(A-2-11. Step ST11)

In step ST11, it is determined whether or not the panel-temperature-compensated detection value of the green-channel brightness sensor is greater than the green-channel feedback-control target value.

If the detection value is determined to be greater than the target value, the process proceeds to step ST12. If the detection value is determined to be smaller than the target value, the process proceeds to step ST13.

(A-2-12. Step ST12)

In step ST12, the PWM controller 7 is controlled such that the electric power supplied to the green LED group 52 (FIG. 3) is reduced by a certain amount and, thereafter, the process proceeds to step ST14.

(A-2-13. Step ST13)

In step ST13, the PWM controller 7 is controlled such that the electric power supplied to the green LED group 52 (FIG. 3) is increased by a certain amount and, thereafter, the process proceeds to step ST14.

(A-2-14. Step ST14)

Next, in step ST14, a comparison is made between the panel-temperature-compensated detection value of the blue-channel brightness sensor resulted from the calculation equation (12) and the blue-channel feedback-control target value defined according to the calculation equation (3) to calculate the absolute difference value therebetween and, then, it is determined whether or not the absolute difference value is equal to or less than a predetermined threshold value (threshold value C). This determination operation is executed by a comparison means 8 in the MPU 17 illustrated in FIG. 1.

If the difference between the detection value and the target value is equal to or less than the threshold value C, the process proceeds to step ST18. On the other hand, if the difference between the detection value and the target value exceeds the threshold value C, the process proceeds to step ST15.

(A-2-15. Step ST15)

In step ST15, it is determined whether or not the panel-temperature-compensated detection value of the red-channel brightness sensor is greater than the red-channel feedback-control target value.

If the detection value is determined to be greater than the target value, the process proceeds to step ST16. If the detection value is determined to be smaller than the target value, the process proceeds to step ST17.

(A-2-16. Step ST16)

In step ST16, the PWM controller 7 is controlled such that the electric power supplied to the blue LED group 53 (FIG. 3) is reduced by a certain amount and, thereafter, the process proceeds to step ST18.

(A-2-17. Step ST17)

In step ST17, the PWM controller 7 is controlled such that the electric power supplied to the blue LED group 53 (FIG. 3) is increased by a certain amount and, thereafter, the process proceeds to step ST18.

(A-2-18. Step ST18)

In step ST18, it is determined whether or not the brightness or color-temperature changing operations have been performed. If any of the changing operations has been performed, the process returns to step ST1 where the respective parameters are set again and the operations from step ST1 are repeated.

On the other hand, if any changing operation has not been performed, the process returns to step ST3 and the feedback processing is repeated.

Plural color-temperature set values are preset in advance and an arbitrary one can be selected. In the case of changing the setting of the color temperature, the operations from step ST1 are repeated.

(A-3. Effects and Advantages)

As described above, the liquid crystal display device 100 according to the present invention applies compensation for the temperature change to the brightness-sensor detection value to obtain a compensated light sensor detected value, further applies compensation for the temperature change in the spectral transmittance of the liquid crystal display panel to the compensated light sensor detection value to obtain a panel-temperature-compensated light sensor detected value. Further, the liquid crystal display device 100 compares the panel-temperature-compensated light sensor detection value with a feedback-control target value and, if it does not reach the feedback-control target value or if it exceeds the feedback-control target value, the device 100 performs controls for increasing or reducing the electric power supplied to the respective LEDs for R, G and B, which can compensate for the changes of the detection value of the brightness sensor 4 and the color of the liquid crystal display panel 1 caused by the temperature rise within the display cabinet after power-on, thereby stabilizing the brightness and chromaticity of white light soon after the power-on.

Figure 5:
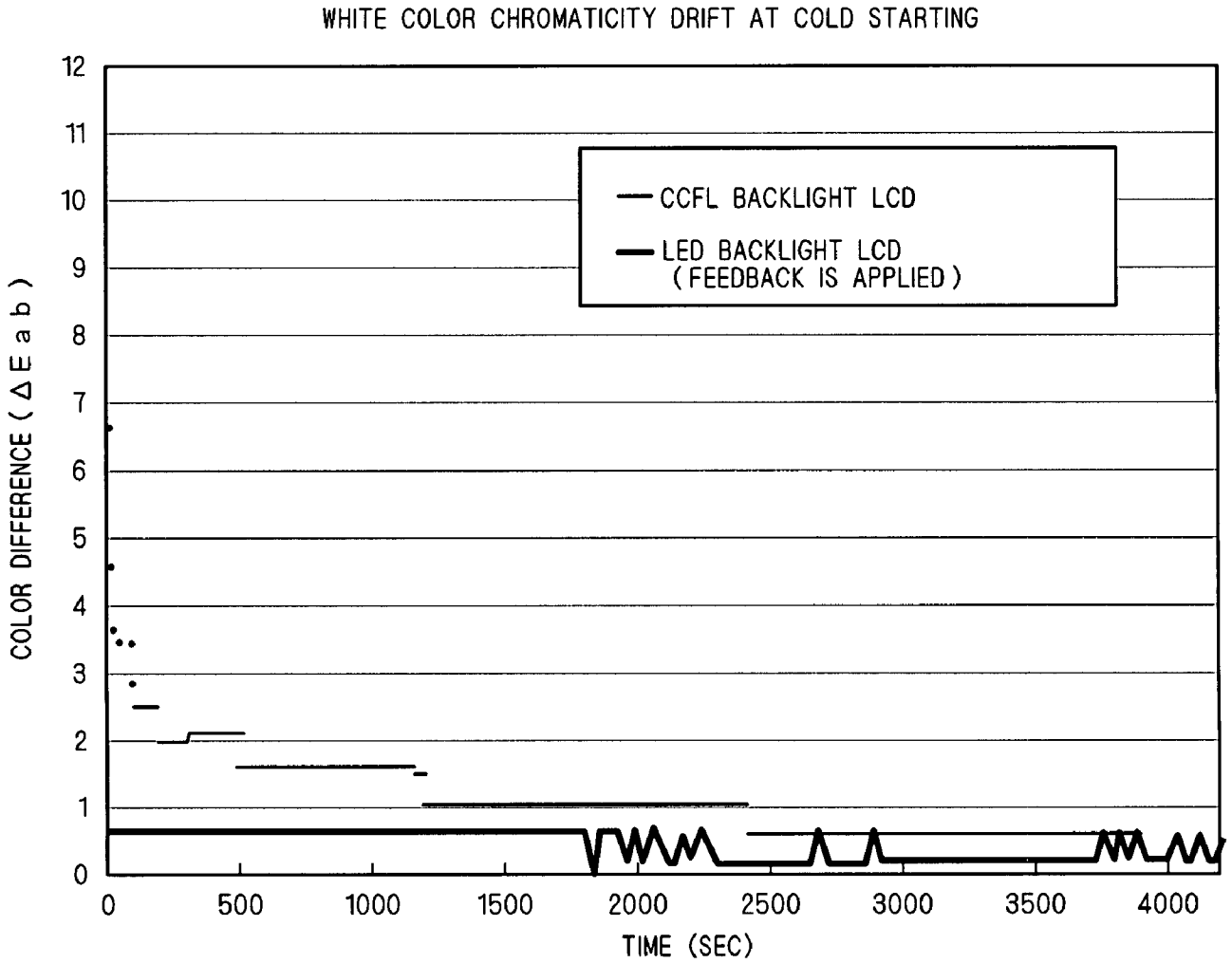
FIG. 5 illustrates a white light fluctuation characteristic of the liquid crystal display panel of the liquid crystal display device according to the first embodiment of the present invention.

FIG. 5 illustrates a white-light fluctuation characteristic of the liquid crystal display panel 1 of the liquid crystal display device 100.

In FIG. 5, the horizontal axis represents the elapsed time (second) while the vertical axis represents the color difference (ΔEab) from finally-stabilized brightness and chromaticity.

FIG. 5 also illustrates, for comparison, a white-light fluctuation characteristic of a liquid crystal display monitor employing a conventional cold cathode fluorescent lamp (CCFL) as the backlight source.

As can be seen from FIG. 5, the liquid crystal display device 100 which performs feedback control according to the present invention can converge the ΔEab of white light to below 1 within a single minute just after power-on, while the CCFL backlight LCD requires 10 to 20 minutes to converge the ΔEab of white light to below 1.

As described above, in comparison with the CCDL backlight LCD, the liquid crystal display panel 100 can significantly reduce the time required for stabilizing white light.

B. Second Embodiment (B-1. Device Configuration)

Figure 6:
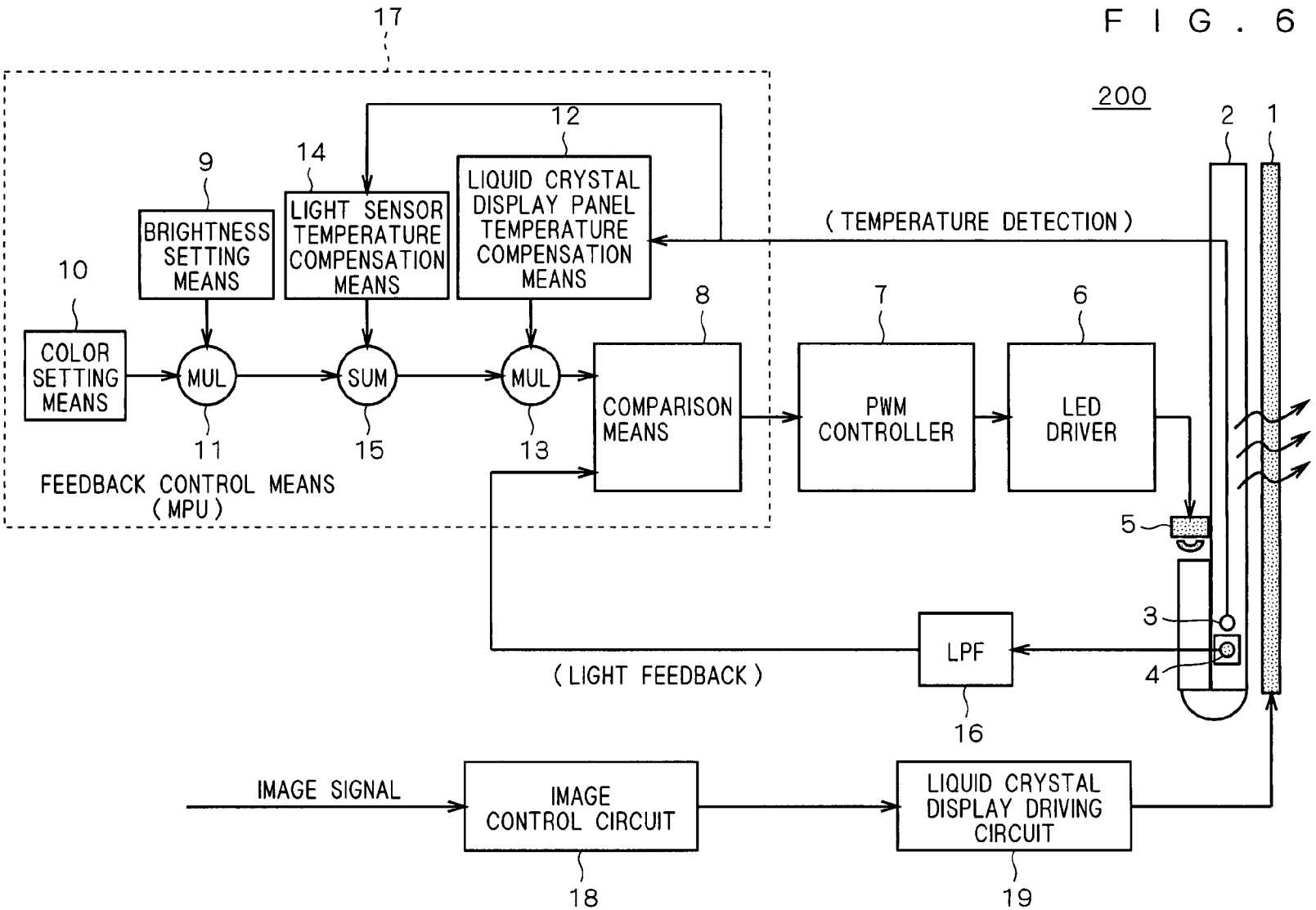
FIG. 6 is a block diagram illustrating the structure of a liquid crystal display device according to a second embodiment of the present invention.

FIG. 6 is a block diagram illustrating the structure of a liquid crystal display device 200 according to a second embodiment of the present invention. In FIG. 6, like reference characters describe the same components as those of the liquid crystal display device 100 illustrated in FIG. 1 and description thereof will not be repeated.

The feedback control means 17 for controlling the PWM controller 7 is configured to include a brightness setting means 9, a color setting means 10, a light sensor temperature compensation means 14 for compensating for fluctuations of the output of the light detection means 4 (referred to as a light sensor or a brightness sensor, in some cases) due to the temperature changes, a liquid crystal display panel temperature compensation means 12 for compensating for fluctuations of the spectral transmittance of the liquid crystal display panel due to the temperature changes, a multiplication means 11 which receives the outputs of the brightness setting means 9 and the color setting means 10, an addition means 15 for summing the output of the multiplication means 11 and the output of the light sensor temperature compensation means 14, a multiplication means 13 for multiplying the output of the addition means 15 by the output of the liquid crystal display panel temperature compensation means 12 and, a comparison means 8 which is fed with the output of the multiplication means 13 (namely, the color setting target value to which the light sensor temperature compensation and the liquid-crystal-panel temperature compensation have been applied) at one of the inputs thereof and also is fed with the result of detection by the light detection means 4 at the other input.

Further, the output of the light detection means 4 is supplied to the comparison means 8 in the feedback control means 17 through a low-pass filter 16 for cutting a PWM frequency region for driving the LEDs.

Further, the output of the temperature detection means 3 is supplied to the aforementioned light sensor temperature compensation means 14 and the liquid crystal display panel temperature compensation means 12.

The backlight system used in the liquid crystal display device 200 is the same as the backlight system 21 described using FIG. 2.

Further, the respective structures of the light detection means 4, the LED driver 6 and the LED backlight source 5 are also the same as those described using FIG. 3.

(B-2. Device Operation)

Figure 7:
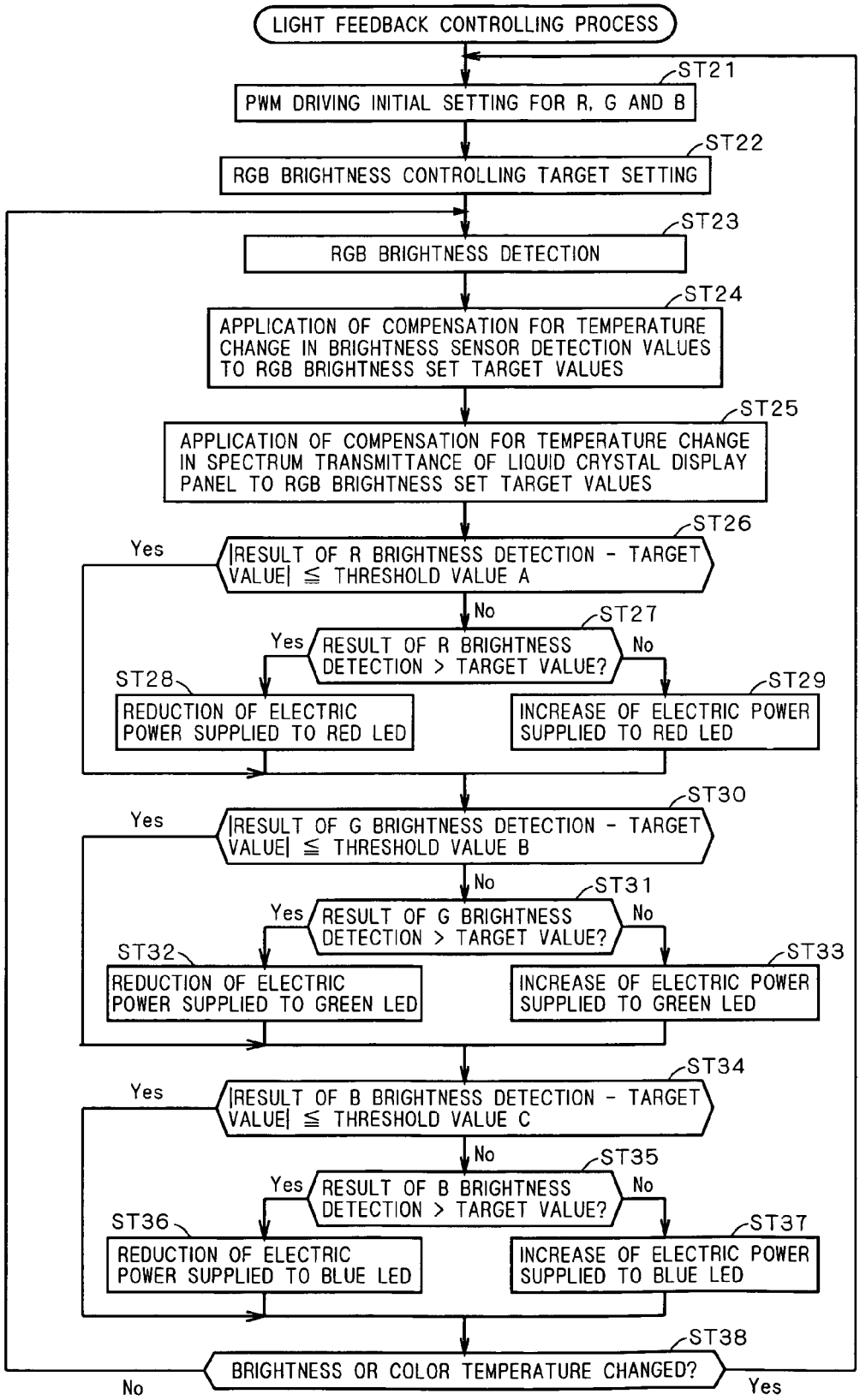
FIG. 7 is a flowchart illustrating a light feedback control processing operation in the liquid crystal display device according to the second embodiment of the present invention.
Figure 8:
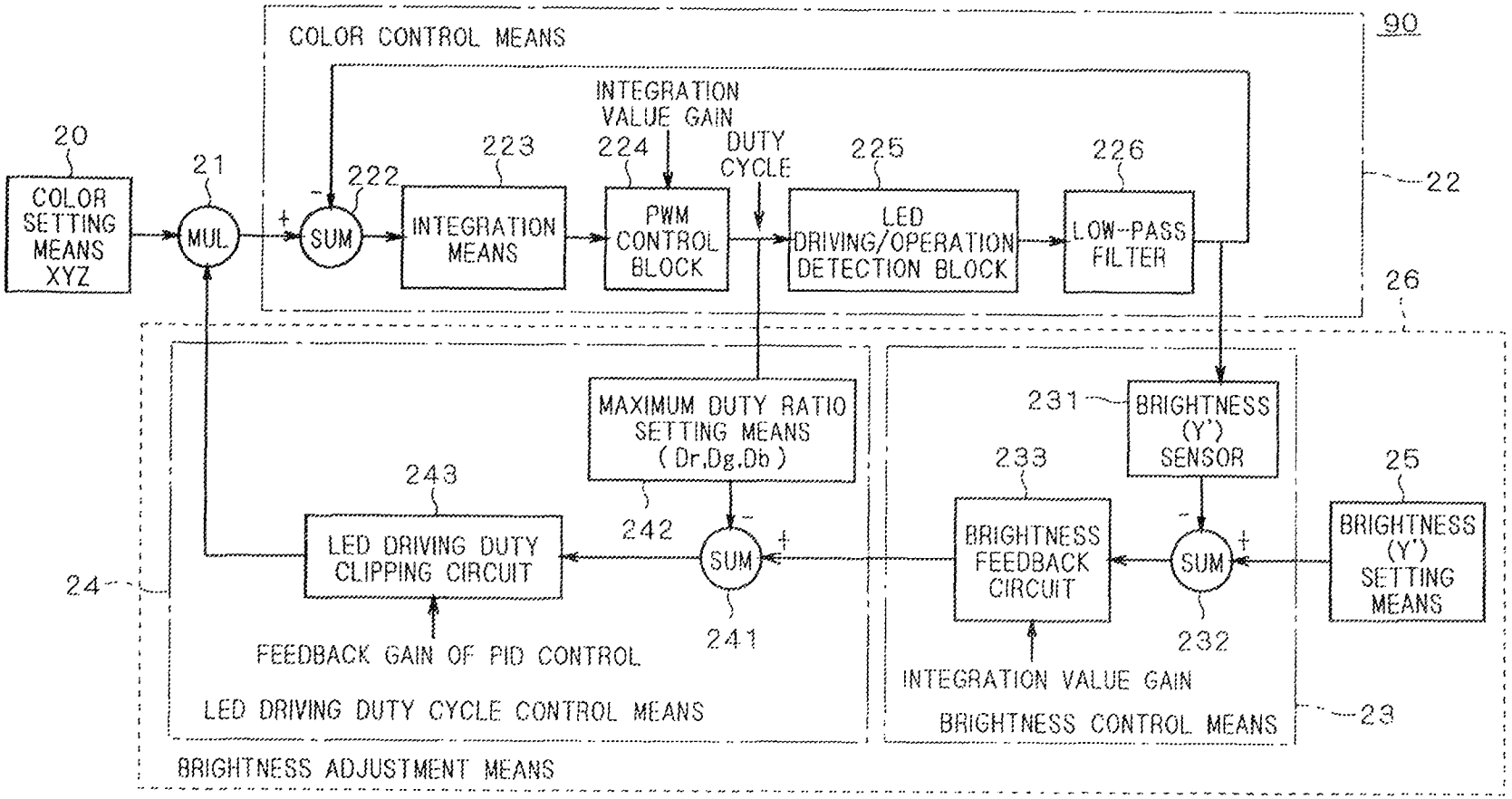
FIG. 8 PRIOR ART
FIG. 8 is a block diagram illustrating the structure of a color stabilizing circuit for the liquid crystal display of a conventional liquid crystal display device.
Figure 10:
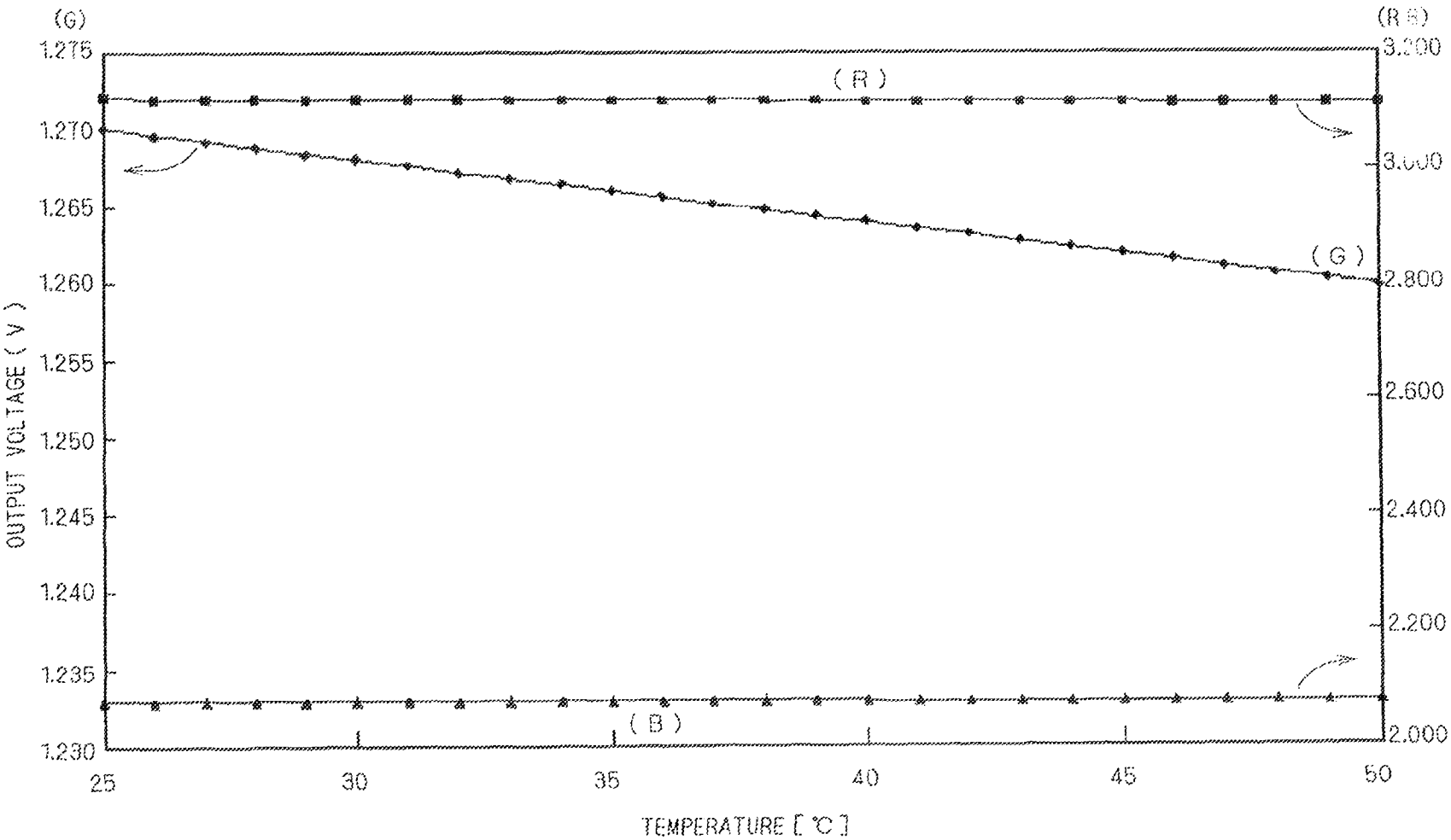
FIG. 10 BACKGROUND ART
FIG. 10 illustrates the relationship between the output voltages of light sensors and the operating temperature.
Figure 11:
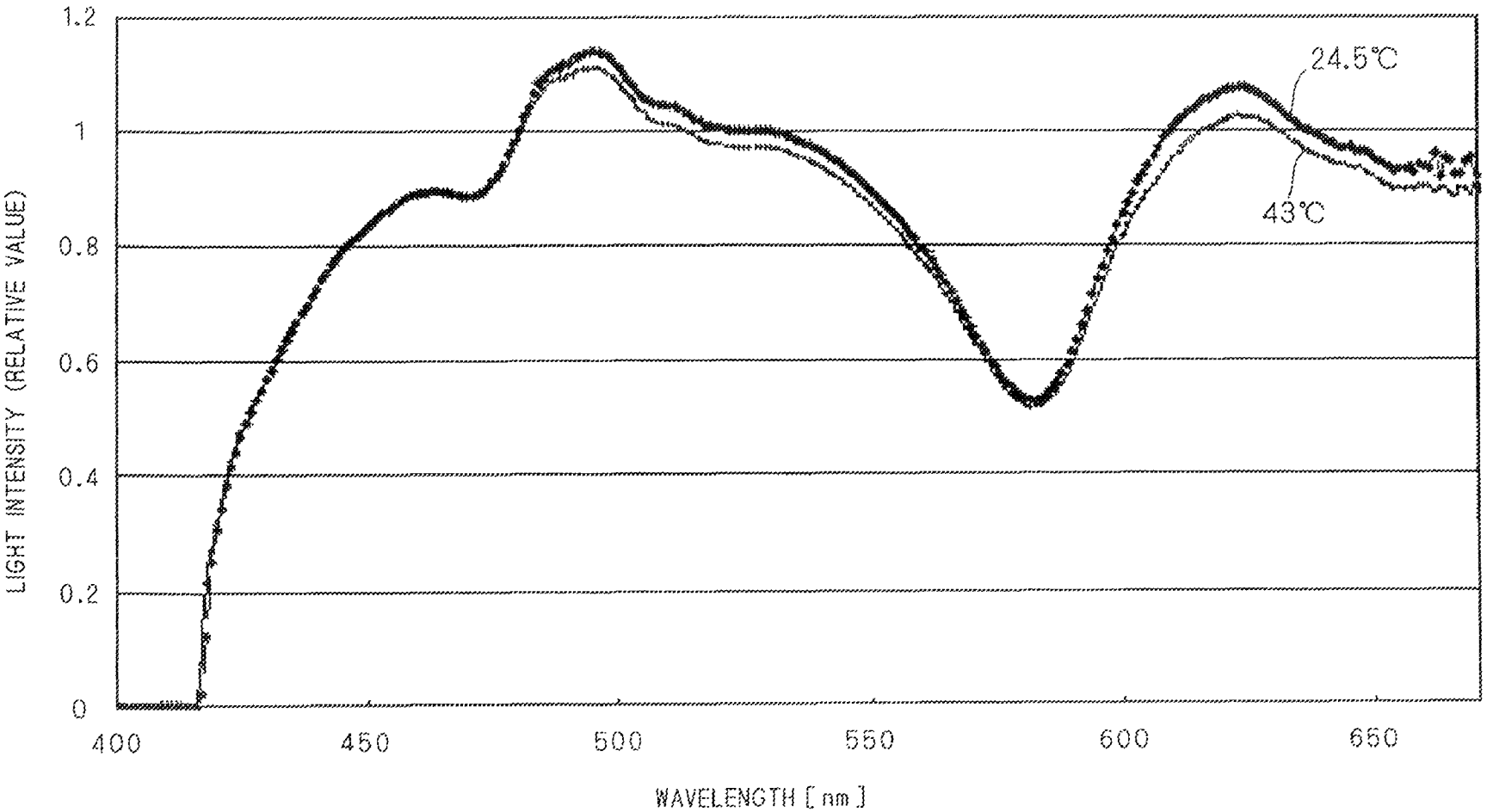
FIG. 11 BACKGROUND ART
FIG. 11 illustrates a temperature-induced fluctuation characteristic of the spectrum transmission of a liquid crystal display panel.
Figure 12:
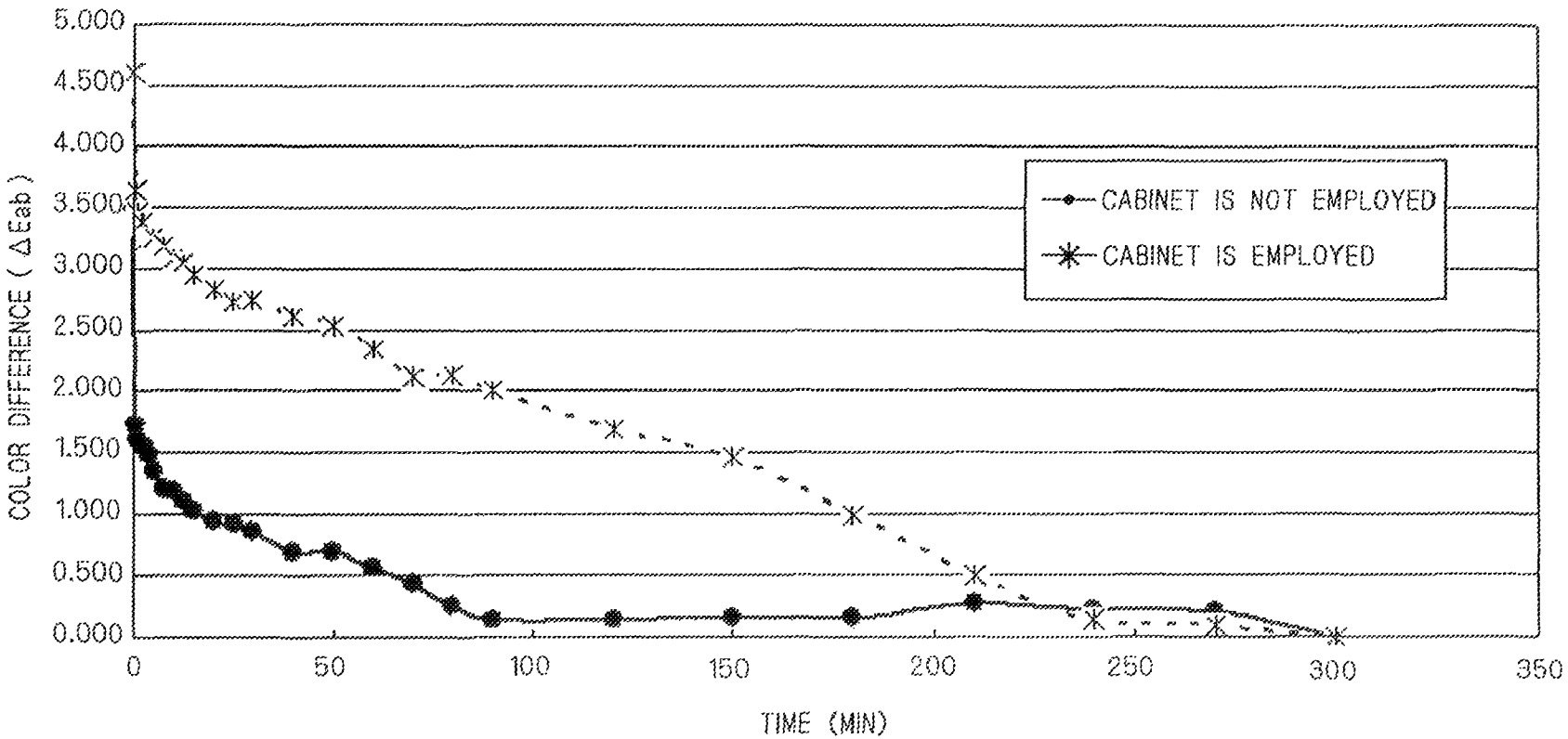
FIG. 12 BACKGROUND ART
FIG. 12 illustrates the result of color stabilizing controls of a conventional liquid crystal display device.

Next, with reference to a flowchart of FIG. 7, there will be described a light feedback-control processing operation in the liquid crystal display device 200.

(B-2-1. Step ST21)

At power-on of the display, the MPU 17 performs initial setting of the PWM-control outputs of the PWM controller 7 for red (R), green (G) and blue (B) (step ST21). This operation is the same as the operation in step ST1 described using FIG. 4 and further description thereof is omitted herein.

(B-2-2. Step ST22)

Then, feedback-control target values (brightness-control target values) corresponding to the R, G and B output values of the brightness sensors 4 are set, in accordance with a predetermined color temperature (Step ST22). This operation is the same as the operation in step ST2 described using FIG. 4 and further description thereof is omitted herein.

The feedback-control target values set in step ST22 are set and determined on the basis of the initial values of the R, G and B feedback-control target values, which have been stored in advance in the nonvolatile memory 30 (FIG. 3) on the basis of the predetermined color temperature, according to the previously-described calculation equations (1), (2) and (3) for the set brightnesses.

(B-2-3. Step ST23)

Next, the R, G and B output values of the light-detection means 4 are detected in step ST23. Further, in the following description, the light detection means 4 will be described as being a brightness sensor 4. Further, since the color of emitted light from the light guide plate 2 can be determined by detecting the brightnesses of the respective colors, R, G and B, and calculating the color using the brightnesses, the brightness sensor 4 can also be referred to as a color detection means. This operation is the same as the operation in step ST3 described using FIG. 4 and further description thereof is omitted herein.

(B-2-4. Step ST24)

Next, in step ST24, compensation for temperature changes in the brightness sensor 4 is applied to the R, G and B feedback-control target values defined according to the aforementioned calculation equations (1), (2) and (3). This process is performed by the light sensor temperature compensation means 14 and the addition means 15 in the MPU 17 illustrated in FIG. 6.

For the compensation, the gain change in the brightness sensor 4 and the dark-current change in the brightness sensor 4 are taken into account, as factors variable with the temperature. The changes due to both the factors are defined as a first-degree equation and are compensated for on the basis of the following equation (13).

$$TGTt(X)=TGT_T(X)+\text{Gain change in brightness sensor}+\text{Dark current change in brightness sensor}=TGT_T(X)+\Delta t\bullet a(X)'+b' \quad (13)$$

The processing for $\Delta t\bullet a(X)'+b$ in the aforementioned equation (13) is performed by the temperature compensation means 14, and this process can be referred to as a process for setting a compensation value (first compensation value) to the temperature characteristic of the output of the brightness sensor 4.

Detection value of temperature sensor at brightness value of X: T(X)

Feedback control target value at brightness value of X: $TGT_T(X)$

Reference value of temperature sensor at brightness value of X: t(X)

Temperature compensated feedback control target value at brightness value of X: $TGT_t(X)$ Gain change coefficient of brightness sensor at brightness value of X: a(X)'

Dark current change coefficient of brightness sensor at brightness value of X: b'

Temperature difference from reference temperature at brightness value of X:

$$\Delta t(X)=t(X)-T(X)$$

Out of the aforementioned parameters, the reference value of the temperature sensor at a brightness value of X indicates the temperature detected by the temperature sensor 3 at a brightness value of X during the previously described white-color-point adjustment. Further, this reference value is used as the reference temperature, and the temperature compensation values are defined as a function of the temperature change (Δt) with respect to the reference temperature.

The brightness sensors for the respective colors exhibit different gain change coefficients a(X)' at a brightness value of X and, therefore, the calculation equation (13) is represented as follows, in taking into account of the difference among the R, G and B brightness sensors (the difference of the detection-value change per unit temperature change).

$$TGTt(X)(R)=TGT_T(X)+\Delta t\bullet a(X)'(R)+b(R)' \quad (14)$$

$$TGTt(X)(G)=TGT_T(X)+\Delta t\bullet a(X)'(G)+b(G)' \quad (15)$$

$$TGTt(X)(B)=TGT_T(X)+\Delta t\bullet a(X)'(B)+b(B)' \quad (16)$$

Here, TGTt(X)(R), TGTt(X)(G) and TGTt(X)(B) indicate the temperature-compensated feedback-control target values for the red channel, the green channel and the blue channel at a brightness of X. Further, a(X)'(R), a(X)'(G) and a(X)'(B) indicate the gain change coefficients of the brightness sensors for the red channel, the green channel and the blue channel at a brightness of X. Further, b'(R), b'(G) and b'(B) indicate the dark-current change coefficients of the brightness sensors for the red channel, the green channel and the blue channel. Hereinafter, description will be provided on the basis of the calculation equation (13), for convenience.

(B-2-4-1. Determination of Gain Change Coefficient of Brightness Sensor)

Here, the gain change coefficient a(X) of a brightness sensor is determined according to the following calculation equation (17).

$$a(X)'=\{ADC(\text{Top})-ADC(Bot)\}\bullet(\text{Base_}a(X)'/\{\text{Base_}ADC(\text{Top})-\text{Base_}ADC(Bot)\} \quad (17)$$

Reference ADC upper limit of brightness sensor: Base_ADC (Top)

Reference ADC lower limit of brightness sensor: Base_ADC (Bot)

Reference temperature change coefficient of brightness sensor: Base_a(X)'

Further, the coefficient defined as (Base_a(X)'/{Base_ADC(Top)−Base_ADC(Bot)} in the right-hand side of the calculation equation (17) is stored, as a correction coefficient (parameter) value, in the nonvolatile memory 30 (FIG. 3).

Further, the aforementioned correction coefficient can be rewritten by an operator during manufacturing, through operations of adjustment push buttons provided on the OSD (On Screen Display) and the display bezel portion or through commands transmitted via means for communicating with external devices.

Further, ADC(Top) and ADC(Bot) in {ADC(Top)−ADC(Bot)} in the left-hand side of the calculation equation (8) indicate the outputs of the AD conversion circuit 45 which correspond to the maximum output voltage and the minimum output voltage of the brightness sensor. Further, ADC(Top) and ADC(Bot) are values specific to the liquid crystal display device and are stored in the nonvolatile memory 30 (FIG. 30). Further, these values can be also rewritten by an operator during manufacturing, through operations of adjustment push buttons provided on the OSD (On Screen Display) and the display bezel portion or through commands transmitted via means for communicating with external devices.

(B-2-4-2. Determination of Dark Current Change Coefficient of Brightness Sensor)

Here, the dark-current change coefficient b' of the brightness sensor is determined according to the following calculation equation (18).

$$b'=\Delta Isens\bullet Rsens\bullet ADC\text{range}/Vsens \quad (18)$$

Electric current change: ΔIsens

Resistance for converting sensor electric current into voltage: Rsens

Variable range of sensor output voltage: Vsens

Sensor ADC detection output range: ADCrange

The aforementioned parameters are individually defined for the red, green and blue channels, and the dark-current change coefficient b' of the brightness sensor is varied depending on the channel, as indicated by the calculation equations (14) to (16).

(B-2-5. Step ST25)

Next, in step ST25, compensation for the spectral transmittance characteristic of the liquid crystal display panel caused by the temperature change is applied to the temperature-compensated feedback-control target value TGTt(X) at a brightness value of X, which has been resulted from the compensation on the basis of the calculation equation (13). This process is executed by the liquid crystal display panel temperature compensation means 12 and the multiplication means 13 in the MPU 17 illustrated in FIG. 16.

This compensating process is performed on the basis of the following calculation equations (19) to (21).

$$TGT_{LCDT(R)}=TGTt(X)(R)\bullet\Delta t\bullet LCD\text{drift}(R)' \quad (19)$$

$$TGT_{LCDT(G)}=TGTt(X)(G)\bullet\Delta t\bullet LCD\text{drift}(G)' \quad (20)$$

$$TGT_{LCDT(B)}=TGTt(X)(B)\bullet\Delta t\bullet LCD\text{drift}(B)' \quad (21)$$

The processing for Δt•LCDdrift(R)', Δt•LCDdrift(G)' and Δt•LCDdrift(B)' in the aforementioned equations (19) to (21) is executed by the liquid crystal display panel temperature compensation means 12 and, this processing can be referred to as processing for setting a compensation value (second compensation value) to the temperature characteristic of the spectral transmittance of the liquid crystal display panel.

$TGT_{LCDT(R)}$: Panel temperature compensated feedback control target value for red channel $TGT_{LCDT(G)}$: Panel temperature compensated feedback control target value for green channel $TGT_{LCDT(B)}$: Panel temperature compensated feedback control target value for blue channel TGTt(X)(R): Feedback control target value for red channel (after sensor temperature compensation)

TGTt(X)(G): Feedback control target value for green channel (after sensor temperature compensation)

TGTt(X)(B): Feedback control target value for blue channel (after sensor temperature compensation)

LCDdrift(R)': Temperature change coefficient of liquid crystal display panel, for red channel LCDdrift(G)': Temperature change coefficient of liquid crystal display panel, for green channel LCDdrift(B)': Temperature change coefficient of liquid crystal display panel, for blue channel (B-2-6. Step ST26)

Next, in step ST6, a comparison is made between the panel-temperature-compensated feedback-control target value for the red channel determined according to the calculation equation (19) and the red-channel brightness detection value from the brightness sensor 4 to calculate the absolute difference value therebetween and, then, it is determined whether or not the absolute difference value is equal to or less than a predetermined threshold value (threshold value A). This determination operation is executed by the comparison means 8 in the MPU 17 illustrated in FIG. 6.

If the difference between the detection value and the target value is equal to or less than the threshold value A, the process proceeds to step ST30. On the other hand, if the difference between the detection value and the target value exceeds the threshold value A, the process proceeds to step ST27.

(B-2-7. Step ST27)

In step ST27, it is determined whether or not the detection value of the brightness sensor for the red channel is greater than the panel-temperature-compensated feedback-control target value for the red-channel.

If the detection value is determined to be greater than the target value, the process proceeds to step ST28. If the detection value is determined to be smaller than the target value, the process proceeds to step ST29.

(B-2-8. Step ST28)

In step ST28, the PWM controller 7 is controlled such that the electric power supplied to the red LED group 51 (FIG. 3) is reduced by a certain amount and, thereafter, the process proceeds to step ST30.

(B-2-9. Step ST29)

In step ST29, the PWM controller 7 is controlled such that the electric power supplied to the red LED group 51 (FIG. 3) is increased by a certain amount and, thereafter, the process proceeds to step ST30.

(B-2-10. Step ST30)

Next, in step ST30, a comparison is made between the panel-temperature-compensated feedback-control target value for the green channel determined according to the calculation equation (20) and the green-channel brightness detection value from the brightness sensor 4 to calculate the absolute difference value therebetween and, then, it is determined whether or not the absolute difference value is equal to or less than a predetermined threshold value (threshold value B). This determination operation is executed by the comparison means 8 in the MPU 17 illustrated in FIG. 6.

If the difference between the detection value and the target value is equal to or less than the threshold value B, the process proceeds to step ST34. On the other hand, if the difference between the detection value and the target value exceeds the threshold value B, the process proceeds to step ST31.

(B-2-11. Step ST31)

In step ST31, it is determined whether or not the detection value of the brightness sensor for the green channel is greater than the panel-temperature-compensated feedback-control target value for the green-channel.

If the detection value is determined to be greater than the target value, the process proceeds to step ST32. If the detection value is determined to be smaller than the target value, the process proceeds to step ST33.

(B-2-12. Step ST32)

In step ST32, the PWM controller 7 is controlled such that the electric power supplied to the green LED group 52 (FIG. 3) is reduced by a certain amount and, thereafter, the process proceeds to step ST34.

(B-2-13. Step ST33)

In step ST33, the PWM controller 7 is controlled such that the electric power supplied to the green LED group 52 (FIG. 3) is increased by a certain amount and, thereafter, the process proceeds to step ST34.

(B-2-14. Step ST34)

Next, in step ST34, a comparison is made between the panel-temperature-compensated feedback-control target value for the blue channel determined according to the calculation equation (21) and the blue-channel brightness detection value from the brightness sensor 4 to calculate the absolute difference value therebetween and, then, it is determined whether or not the absolute difference value is equal to or less than a predetermined threshold value (threshold value C). This determination operation is executed by the comparison means 8 in the MPU 17 illustrated in FIG. 6.

If the difference between the detection value and the target value is equal to or less than the threshold value C, the process proceeds to step ST38. On the other hand, if the difference between the detection value and the target value exceeds the threshold value C, the process proceeds to step ST35.

(B-2-15. Step ST35)

In step ST35, it is determined whether or not the detection value of the brightness sensor for the blue channel is greater than the panel-temperature-compensated feedback-control target value for the blue-channel.

If the detection value is determined to be greater than the target value, the process proceeds to step ST36. If the detection value is determined to be smaller than the target value, the process proceeds to step ST37.

(B-2-16. Step ST36)

In step ST36, the PWM controller 7 is controlled such that the electric power supplied to the blue LED group 53 (FIG. 3) is reduced by a certain amount and, thereafter, the process proceeds to step ST38.

(B-2-17. Step ST37)

In step ST37, the PWM controller 7 is controlled such that the electric power supplied to the blue LED group 53 (FIG. 3) is increased by a certain amount and, thereafter, the process proceeds to step ST38.

(B-2-18. Step ST38)

In step ST38, it is determined whether or not the brightness or color-temperature changing operations have been performed. If any of the changing operations has been performed, the process returns to step ST21 where the respective parameters are set again and the operations from step ST21 are repeated.

On the other hand, if any changing operation has not been performed, the process returns to step ST23 and the feedback processing is repeated.

Plural color-temperature set values are preset in advance and an arbitrary one can be selected. In the case of changing the setting of the color temperature, the operations from step ST1 are repeated.

(B-3. Effects and Advantages)

As described above, the liquid crystal display device 200 according to the present invention applies compensation for the temperature change in the brightness-sensor detection value to a feedback-control target value to obtain a compensated feedback-control target value, further applies compensation for the temperature change in the spectral transmittance of the liquid crystal display panel to the compensated feedback-control target value to obtain a panel-temperature-compensated feedback-control target value. Further, the liquid crystal display device 200 compares the panel-temperature-compensated feedback-control target value with the detection value from the brightness sensor 4 and, if the detection value from the brightness sensor does not reach the panel-temperature-compensated feedback-control target value or if it exceeds the panel-temperature-compensated feedback-control target value, the device 200 performs control for increasing or reducing the electric power supplied to the respective LEDs for R, G and B, which can compensate for the changes of the detection value of the brightness sensor 4 and the color of the liquid crystal display panel 1 caused by the temperature rise within the display cabinet after power-on, thereby stabilizing the brightness and chromaticity of white light soon after the power-on.

While the invention has been shown and described in detail, the foregoing description is in all aspects illustrative and not restrictive. It is therefore understood that numerous modifications and variations can be devised without departing from the scope of the invention.

What is claimed is:

1. A liquid crystal display device which uses, as backlight of a liquid crystal display panel, white light generated from a light guide plate adapted to mix plural monochromatic lights into white light, said liquid crystal display device comprising:

control means for individually controlling the light intensities of plural light sources for said plural monochromatic lights, the plural light sources including red, green, and blue light sources;

light detection means for detecting the brightness of the white light of said backlight, the light detection means including red, green, and blue brightness sensors;

a temperature detection unit that measures the temperature in the vicinity of said liquid crystal display panel; and a feedback controller that receives the brightness detection value detected by said light detection means and performs a feedback control to said control means in terms of the electric power supplied to said plural light sources such that said brightness detection value is brought into agreement with a set brightness, wherein said feedback controller is configured to modify a value of the detected brightness that is output by said light detection means by performing:

a first temperature compensation that sets a first compensation value to compensate for a predetermined temperature-induced fluctuation characteristic of said light detection means which causes the output of said light detection means for a given level of brightness to fluctuate according to a change in temperature, the first compensation value being set by multiplying the difference between the temperature detected by said temperature detection unit and a preset reference temperature by a gain change coefficient indicative of the change in the detection gain of said light detection means with respect to the temperature change; and a second temperature compensation that sets a second compensation value to compensate for a predetermined temperature-induced fluctuation characteristic of said liquid crystal display panel, which is independent of said light sources, and which causes the spectral transmittance of the liquid crystal display panel to fluctuate according to the change in temperature, the second compensation value being set on the basis of said detected temperature and data stored in a memory representative of said predetermined temperature-induced fluctuation characteristic of said liquid crystal display panel, said feedback controller performs said feedback control on the basis of the modified value of the detected brightness, the gain change coefficient is determined by multiplying the difference between a maximum output value and a minimum output value from said light detection means by a correction coefficient based on a design standard value of the light detection means, and the feedback controller individually performs feedback control of the electric powers supplied to the red, green, and blue light sources to control their light intensities individually.

2. The liquid crystal display device according to claim 1, wherein said feedback controller is configured to make a comparison between:

a feedback-control target value set on the basis of said set brightness, and a panel-temperature-compensated brightness detection value resulting from the multiplication of a temperature-compensated brightness detection value by said second compensation value, said temperature-compensated brightness detection value resulting from the addition of said first compensation value to said brightness detection value detected by said light detection means, and if said panel-temperature-compensated brightness detection value is below said feedback-control target value or if said panel-temperature-compensated brightness detection value exceeds said feedback-control target value, said control means is controlled such that the electric power supplied to said plural light sources is reduced or increased.

3. The liquid crystal display device according to claim 1, wherein said feedback controller is configured to make a comparison between:

said brightness detection value detected by said light detection means, and a panel-temperature-compensated feedback-control target value resulting from the multiplication of a temperature-compensated feedback-control target value by said second compensation value, said temperature-compensated feedback-control target value resulting from the addition of said first compensation value to a feedback-control target value defined on the basis of said set brightness, and if said panel-temperature-compensated-feedback-control target value is below said brightness detection value or if said panel-temperature-compensated feedback-control target value exceeds said brightness detection value, said control means is controlled such that the electric power supplied to said plural light sources is reduced or increased.

4. The liquid crystal display device according to claim 1, wherein said red, green and blue brightness sensors employ band-pass filters of red, green and blue lights for dispersing white light from said backlight source into red, green and blue monochromatic lights and then detecting the brightnesses of the respective lights, and said plural light sources include red, green and blue light emitting diodes.

5. A liquid crystal display device which uses, as backlight of a liquid crystal display panel, white light generated from a light guide plate adapted to mix plural monochromatic lights into white light, said liquid crystal display device comprising:

control means for individually controlling the light intensities of plural light sources for said plural monochromatic lights, the plural light sources including red, green, and blue light sources;

light detection means for detecting the brightness of the white light of said backlight, the light detection means including red, green, and blue brightness sensors;

a temperature detection unit that measures the temperature in the vicinity of said liquid crystal display panel;

a feedback controller that receives the brightness detection value detected by said light detection means and performs a feedback control to said control means in terms of the electric power supplied to said plural light sources such that said brightness detection value is brought into agreement with a set brightness; and a readable and writable storage device, wherein said feedback controller is configured to perform:

a first temperature compensation that sets a first compensation value to compensate for the temperature characteristic of the output of said light detection means caused by the temperature change, on the basis of the temperature detected by said temperature detection unit; and a second temperature compensation that sets a second compensation value to the temperature characteristic of the spectral transmittance of said liquid crystal display panel, which is independent of said light sources and caused by the temperature change, on the basis of said detected temperature and data stored in a memory representative of said temperature characteristic of said liquid crystal display panel, said feedback controller performs said feedback control on the basis of said first and second compensation values, said first compensation value according to said first temperature compensation is set by multiplying the difference between said temperature detected by said temperature detection unit and a preset reference temperature by a gain change coefficient indicative of the change in the detection gain of said light detection means with respect to the temperature change, said gain change coefficient is determined by multiplying the difference between a maximum output value and a minimum output value from said light detection means by a correction coefficient set on the basis of a design standard value of said light detection means, said correction coefficient, said maximum output value and minimum output value from said light detection means are stored in said storage device, said storage device is structured to be writable from the outside, and the feedback controller individually performs feedback control of the electric powers supplied to the red, green, and blue light sources to control their light intensities individually.

6. The liquid crystal display device according to claim 1, wherein said second compensation value according to said second temperature compensation is set by multiplying the difference between said temperature detected by said temperature detection unit and a preset reference temperature by a temperature change coefficient indicative of the change in the spectral transmittance of said liquid crystal display panel with respect to the temperature change.

7. The liquid crystal display device according to claim 6, further comprising:

a readable and writable storage device, wherein said temperature change coefficient is stored in said storage device, and said storage device is structured to be writable from the outside.

8. The liquid crystal display device according to claim 1, further comprising:

a brightness setting unit that enables arbitrarily setting the brightness of said liquid crystal display panel, wherein the content of setting of said brightness setting unit can be changed from the outside.

9. The liquid crystal display device according to claim 1, further comprising:

a color setting unit that enables arbitrarily setting the color of said liquid crystal display panel, wherein the content of setting of said color setting unit can be changed from the outside.

10. A method implemented in a liquid crystal display device which uses, as backlight of a liquid crystal display panel, white light generated from a light guide plate adapted to mix plural monochromatic lights into white light, said method comprising:

individually controlling the light intensities of plural light sources for said plural monochromatic lights, the plural light sources including red, green, and blue light sources;

detecting the brightness of the white light of said backlight with a light detector, the light detector including red, green, and blue brightness sensors;

measuring the temperature in the vicinity of said liquid crystal display panel; and performing by a feedback controller, feedback control of the electric power supplied to said plural light sources based on the detected brightness detection value such that said brightness detection value is brought into agreement with a set brightness, wherein said feedback control performed by said feedback controller includes:

setting a first compensation value to compensate for a predetermined temperature-induced fluctuation characteristic of said light detector which causes the output of said light detector to fluctuate for a given level of brightness according to a change in temperature, the first compensation value being set by multiplying the difference between the measured temperature and a preset reference temperature by a gain change coefficient indicative of the change in the detection gain of said light detector with respect to the temperature change;

setting a second compensation value to compensate for a predetermined temperature-induced fluctuation characteristic of said liquid crystal display panel, which is independent of said light sources, and which causes the spectral transmittance of said liquid crystal display to fluctuate according to the change in temperature, the second compensation value being set on the basis of said measured temperature and data stored in a memory representative of said predetermined temperature-induced fluctuation characteristic of said liquid crystal display panel;

modifying a value of the detected brightness output by the light detector according to the first and second compensation values; and performing feedback control on the basis of the modified value, wherein the gain change coefficient is determined by multiplying the difference between a maximum output value and a minimum output value from said light detector by a correction coefficient based on a design standard value of the light detector, and the feedback controller individually performs feedback control of the electric powers supplied to the red, green, and blue light sources to control their light intensities individually.

11. The method according to claim 10, wherein said performing feedback control includes:

setting a feedback-control target value set on the basis of said set brightness;

computing a temperature-compensated brightness detection value by adding the first compensation value to a value of the detected brightness;

computing a panel-temperature-compensated brightness detection value by multiplying the temperature-compensated brightness detection value by said second compensation value;

comparing said feedback-control target value and said panel-temperature-compensated brightness detection value; and if said panel-temperature-compensated brightness detection value is below said feedback-control target value or if said panel-temperature-compensated brightness detection value exceeds said feedback-control target value, reducing or increasing the electric power supplied to said plural light sources.

12. The method according to claim 10, wherein said performing feedback control includes:

computing a temperature-compensated feedback-control target value by adding the first compensation value to a feedback-control target value defined on the basis of said set brightness;

computing a panel-temperature-compensated feedback-control target value by multiplying the temperature-compensated feedback-control target value by said second compensation value;

comparing said a value of the detected brightness to the panel-temperature-compensated feedback-control target value; and if said panel-temperature-compensated feedback-control target value is below said brightness detection value or if said panel-temperature-compensated feedback-control target value exceeds said brightness detection value, reducing or increasing the electric power supplied to said plural light sources.

13. The method according to claim 10, wherein the red, green and blue brightness sensors employ band-pass filters of red, green and blue lights for dispersing white light from said backlight source into red, green and blue monochromatic lights and then detecting the brightnesses of the respective lights, and said plural light sources include red, green and blue light emitting diodes.

14. The method according to claim 10, wherein said gain change coefficient is determined by:

computing the difference between a maximum output value and a minimum output value for said light detector; and multiplying the computed output value difference by a correction coefficient set on the basis of a design standard value of said light detector, said correction coefficient, said maximum output value and minimum output value from said light detection means are stored in externally writable storage.

15. The method according to claim 10, wherein said second compensation value is set by:

computing the difference between said measured temperature and a preset reference temperature; and multiplying the computed difference by a temperature change coefficient indicative of the change in the spectral transmittance of said liquid crystal display panel with respect to the temperature change.

16. The method according to claim 15, wherein said temperature change coefficient is stored in externally writable storage.

17. The method according to claim 10, further comprising:

receiving an input for externally changing the set brightness of said liquid crystal display panel.

18. The method according to claim 10, further comprising:

receiving an input for externally changing a color setting of said liquid crystal display panel.

* * * * *